US010433628B2

(12) United States Patent
Palmer

(10) Patent No.: US 10,433,628 B2
(45) Date of Patent: Oct. 8, 2019

(54) HAIR ADDITION DRYING SYSTEM AND METHOD

(71) Applicant: Kimberly Nicole Palmer, Miami, FL (US)

(72) Inventor: Kimberly Nicole Palmer, Miami, FL (US)

( * ) Notice: Subject to any disclaimer, the term of this patent is extended or adjusted under 35 U.S.C. 154(b) by 357 days.

(21) Appl. No.: 15/297,353

(22) Filed: Oct. 19, 2016

(65) Prior Publication Data

US 2017/0105501 A1 Apr. 20, 2017

Related U.S. Application Data

(60) Provisional application No. 62/243,340, filed on Oct. 19, 2015.

(51) Int. Cl.
*A45D 20/00* (2006.01)
*A45D 20/04* (2006.01)

(52) U.S. Cl.
CPC ..... *A45D 20/04* (2013.01)

(58) Field of Classification Search
CPC ..... A45D 20/04
USPC ..... 34/101, 239, 96, 283
See application file for complete search history.

(56) References Cited

U.S. PATENT DOCUMENTS 3,327,404 A 6/1967 Ganier
3,501,847 A * 3/1970 Sanford ..... A45D 44/14 223/66
3,608,203 A 9/1971 Willat
5,435,837 A 7/1995 Lewis et al.
D468,873 S 1/2003 Varma
6,877,248 B1 4/2005 Cross et al.
7,097,051 B2 8/2006 Schober et al.
7,775,377 B2 * 8/2010 Abney ..... A47F 7/065 211/13.1
8,511,320 B2 8/2013 Sakurai et al.
8,813,385 B2 8/2014 Blum
8,998,002 B1 4/2015 Milner
9,157,180 B2 10/2015 Hu
2005/0198854 A1 * 9/2005 Hobe ..... A45D 19/16 34/96
2005/0247326 A1 * 11/2005 Park ..... A41G 5/0066 132/201
2013/0104922 A1 5/2013 Hall et al.
2016/0219957 A1 8/2016 Dodds
2016/0286880 A1 10/2016 Adjesson
2016/0374447 A1 * 12/2016 Sterling ..... A45D 20/08 34/275

OTHER PUBLICATIONS

Blow Dry Hair Extensions. Hairfinder. Sep. 5, 2015 (Sep. 5, 2015) [online], [retrieved on Aug. 12, 2016]. Retrieved from the Internet: <URL: Jjhttps://web.archive.org/web/20-I5 0905 084024/http://www.hairfinder.com/h1ir3/blowdry - • '1 extensions.htm>.

* cited by examiner

*Primary Examiner* — John P McCormack
(74) *Attorney, Agent, or Firm* — John Rizvi; The Patent Professor ®

(57) ABSTRACT

A hair addition drying system and method is disclosed and includes a dryer defining an elongated internal drying chamber. An internal support assembly is provided to suspend elongated hair additions such that applied drying air flows over the hair additions in a manner that avoids tangling.

18 Claims, 18 Drawing Sheets

HAIR ADDITION DRYING SYSTEM AND METHOD

This application claims the benefit of U.S. Provisional Patent Application Ser. No. 62/243,340, filed Oct. 19, 2015, which is incorporated herein in its entirety.

FIELD OF THE INVENTION

The present invention relates generally to hair drying devices and, more particularly, to a method and system for drying an elongated hair addition while avoiding wrinkling or tangling of individual hair strands.

BACKGROUND OF THE INVENTION

Sometimes a person may desire to augment their appearance with hair additions (i.e. hair additions or artificial hair integrations) for convenience and style. For example, a person's natural hair may require an inconvenient amount of time and work for appropriately styling their hair. As another example, a person having naturally curly hair, but desiring straight hair, may augment their hair with straight hair additions to save time associated with hot-ironing, which can cause burns or hair damage, or to bypass the need for applying harmful chemical straighteners. In some situations, hair additions may be applied to cover bald spots or thinning or damaged hair.

Hair additions can be provided pre-styled in various styles and textures. For example, such styles may include silky straight, yaki, deep wave, loose deep wave or romance wave, jheri curl, wet and wavy, indian wave, etc. A hair addition may be loosely provided (i.e. bulk), or provided attached or wefted to a track, weft or net. Hair additions may be attached to a wearer's head in various ways, such as via crocheting, gluing, micro loops, netting, or sewing. For example, bulk hair additions may be sewed to braids (e.g. corn-rows) of a wearer's natural hair, providing the appearance of the additions being rooted on the wearer's scalp.

Hair additions may require washing and drying. For example, it may make more sense to wash, dry and re-apply a set of premium hair additions. Sometimes, a wearer having worn hair additions for many weeks may require their hair and scalp to be massaged, re-braided, re-styled or re-treated before re-applying previously worn hair additions. As such, sometimes hair additions must be removed before washing the hair additions.

The most common method for drying wet hair additions consists of placing wet hair additions on a surface and drying the wet hair additions via a hand-held hair dryer. Sometimes, professional hair salons may require concurrently drying multiple hair pieces, and this method is insufficient for such. For example, a handheld hair dryer is configured to direct focused air, incapable of drying multiple units of hair additions. Further, applying forced air to hair additions sitting on a surface subjects the hair additions to turbulent or random air convection, causing the hair additions to tangle, and may not evenly dry hair additions because the surface may block air convection from evenly drying all surfaces of the hair additions sitting on the surface. For example, blowing air toward hair additions lying on a table may cause the air to blow perpendicular to the lengths of the hair addition strands, causing tangling. Further, uneven application of air convection or heat may cause damage or breakage to hair. Furthermore, it may take longer for wet hair additions to dry while resting on a surface.

There exists drying cabinets for drying multiple hair wigs at once. For example, such drying cabinets include wig mannequin heads or shelves as surfaces to support a wet wig being dried. However, such drying cabinets still require the wigs to be placed on a surface, causing uneven drying as described above, and the cabinets are not configured to evenly dry bulk or loose hair additions or extensions.

Accordingly, there is a need for a hair drying system and method for evenly drying hair additions while keeping the hair additions from tangling or becoming damaged.

SUMMARY OF THE INVENTION

The present invention is directed to a hair drying system for uniformly drying elongated hair additions without risk of tangling. Introducing a first embodiment of a hair drying system for uniformly drying elongated hair additions, the hair drying system includes, a dryer defining an elongated internal drying chamber, an air intake system positioned at one end of the internal drying chamber, an air exhaust system positioned at a second end of the internal drying chamber; and an internal support assembly for receipt of elongated hair additions, the internal support assembly being positioned within the internal chamber between the air intake system and the air exhaust system such that air flowing between the air intake and exhaust systems flows across the elongated hair additions in a substantially laminar fashion.

In a second aspect, the air intake system includes at least one ducted intake fan positioned near a top of the internal chamber.

In another aspect, the air intake system includes at least one ducted intake fan positioned in a top panel of the dryer.

In another aspect, the air exhaust system includes at least one ducted fan positioned near a bottom of the internal chamber.

In another aspect, the air exhaust system includes at least one ducted fan positioned in a side wall of the dryer adjacent a bottom panel of the dryer.

In another aspect, a control interface is provided on the dryer, the control interface functioning to operate the air intake and air exhaust systems.

In another aspect, an internal support system is provided within the internal chamber between the air intake system and the air exhaust system, the internal support system having support for releasably hanging a hair addition.

In another aspect, the internal support system includes a support bar mounted to the dryer and a sliding member, movably mounted on the support bar, for addition and removal of a hair addition.

In another aspect, the hair drying system further includes a hooked hair addition support for supporting the hair addition within the drying chamber.

In another aspect, the hair drying system further includes a diffuser for covering the hair addition during the drying process.

There is also disclosed a method of uniformly drying an elongated hair addition, comprising, providing a dryer defining an elongated internal drying chamber, an air intake system positioned at one end of the internal drying chamber, an air exhaust system positioned at a second end of the internal drying chamber, an internal support assembly for receipt of elongated hair additions, the internal support assembly being positioned within the internal chamber between the air intake system and the air exhaust system such that air flowing between the air intake and exhaust systems flows across the elongated hair additions in substantially laminar fashion (i.e. parallel to a length of the hair additions that are hanging), suspending a hair addition from the internal support assembly, activating the air intake system to cause drying air to flow into the internal chamber of the dryer and activating the air exhaust system to cause the drying air to flow across the suspended hair addition in laminar fashion.

In other examples, disclosed is a drying method for drying a hair addition having multiple strands of hair, the method comprising, elevatingly supporting one end of the hair addition via a support and applying air to the hair addition for drying the hair addition such that the strands are prevented from tangling.

In another aspect, the air is diffused via a diffuser.

In another aspect, the method further comprises, manually engaging the hair addition while the air is applied to the hair addition.

In another aspect, the method further comprises, hanging the hair addition from the support.

In another aspect, the support is a clip.

In another aspect, the support includes a clamp configured to clamp onto a fixed structure.

In another aspect, the support includes an elevated bar.

Further disclosed is a drying system for drying a hair addition having multiple strands of hair, the system comprising, a dryer defining an internal drying chamber, an internal support assembly configured to support the hair addition in the internal drying chamber as a supported hair addition, an air flow system configured to provide flowing air to the supported hair addition for drying the hair addition.

In another aspect, the air flow system includes an air flow tube configured to direct air to the supported hair addition.

In another aspect, the system further comprises a diffuser that is configured to diffuse the air before the supported hair addition is subjected to the air.

In another aspect, the diffuser is configured to cover the supported hair addition.

Further disclosed is a holder for supporting a hair addition, the holder comprising, a clamp configured to clamp onto a fixed structure, and a clip configured to hold a hair addition while the hair addition is handled.

In another aspect, the holder further comprises a second clamp.

In another aspect, the clamps are each located toward opposite longitudinal ends of the clip.

In another aspect, the clip is generally longitudinal.

In another aspect, the clip is removably supportable on the clamp.

In another aspect, the clip includes an arm that is configured to open to an opened state and close to a closed state, such that in the closed state the hair addition is holdable in the clip.

In another aspect, the clamp includes a vertical bar that is configured to be secured to the clip.

In another aspect, the clip is vertically adjustable along the vertical bar.

In another aspect, the fixed structure is a table.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
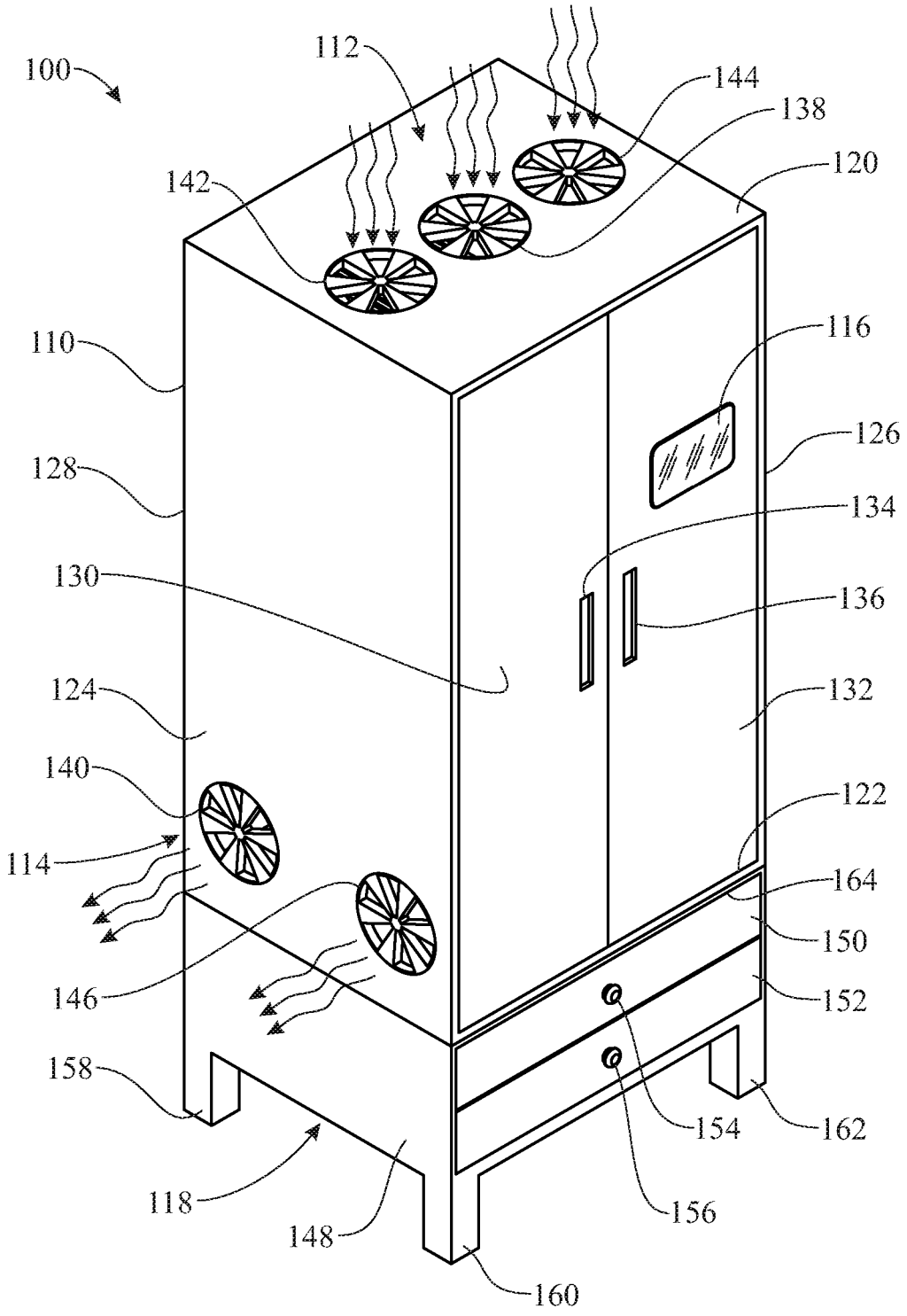
FIG. 1 presents an isometric view of a first example of a hair drying system, in accordance with aspects of the invention.
Figure 2:
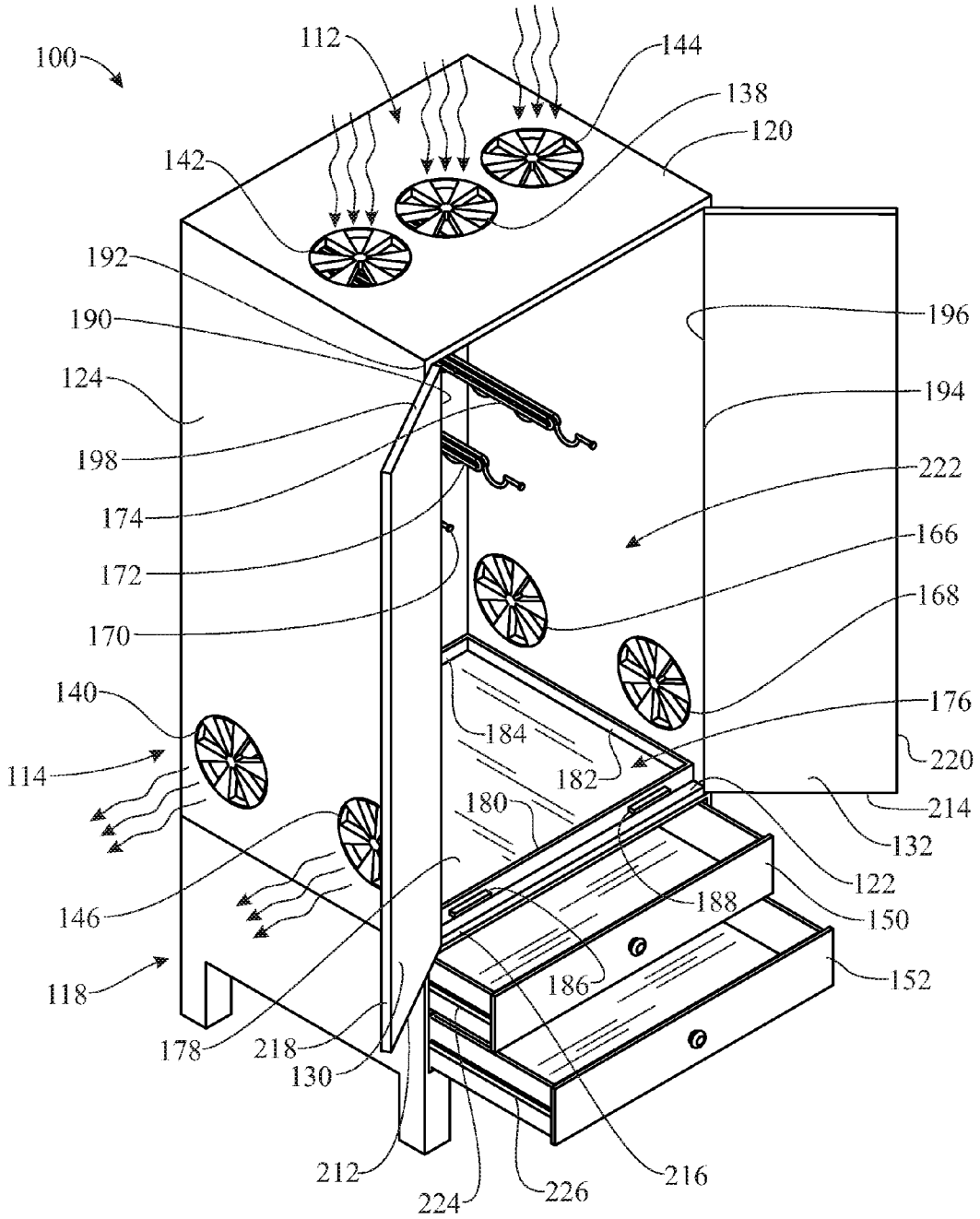
FIG. 2 presents an isometric view of the first example of the hair drying system with doors of a dryer open and associated drawers of a base pulled out, in accordance with aspects of the invention.
Figure 3:
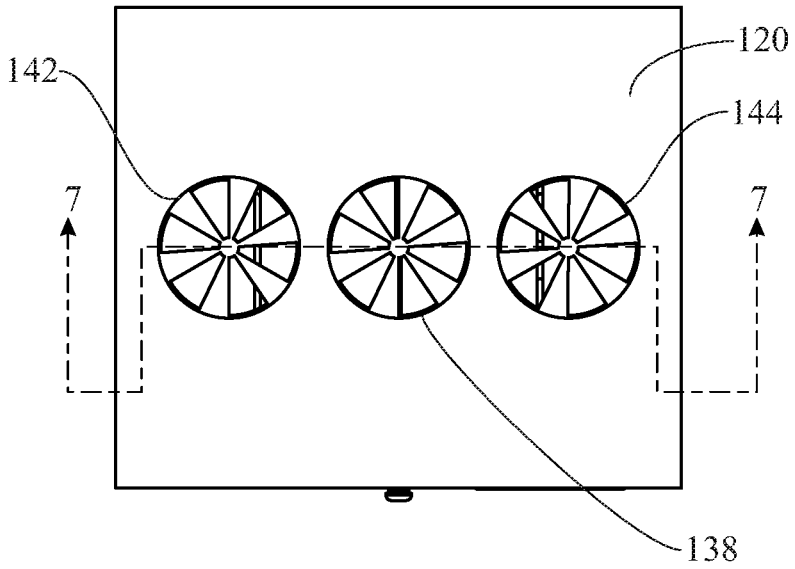
FIG. 3 presents a top plan view of the first example of the hair drying system, in accordance with aspects of the invention.

Referring to FIGS. 1-3, and initially with regard to FIG. 1, a hair drying system 100 is illustrated in accordance with an exemplary embodiment of the present invention. The hair drying system 100 is provided to dry hair additions and, more particularly, to safely and conveniently dry loose (bulk) or wefted hair additions without risk of tangling individual hairs within a hair addition unit, or between two or more units of hair additions. For example, a hair addition may be a unit of a bunch of individual strands. Such a unit may be wefted or otherwise grouped in any appropriate manner. In some instances, the unit may include a group of loose strands. In some embodiments, the unit of grouped strands of a hair addition may include a clip to keep the unit grouped and intact when subjected to air convection or flow. Any appropriate number of strands may be included in a unit or group of hair additions.

The hair drying system 100 generally includes a dryer 110 for receiving, holding and containing of one or more hair additions in a substantially closed environment and an intake system 112 and an exhaust system 114 for circulating drying air through the dryer to dry the hair additions contained therein. For example, the dryer 110 may generally be in the shape or form of a cabinet. A substantially closed environment may be provided by enclosing an internal space (i.e. internal chamber) of the dryer 110, with the exception of openings provided for appropriate air flow, the appropriate air flow configured to blow substantially parallel to hanging hair additions disposed in the dryer 110. A control interface 116 is provided to regulate or direct the air flow through the intake and exhaust systems 112 and 114, respectively, as well as regulate the internal temperature and humidity within the dryer 110 and the drying time. For example, the control interface 116 may be configured for selecting a speed (i.e. slow, medium, fast) of air convection. For example, a slow selection may cause the intake and/or exhaust to operate at a slow speed, and a fast selection may cause the intake and/or exhaust to operate at a fast speed. For example, the control interface 116 may be operatively connected with a computing system, and may include an LCD display for displaying an interactable graphical user interface. A base 118 is provided to raise the dryer 110 to a convenient level and to store accessories.

The dryer 110 generally includes a top panel 120, a bottom panel 122 and first and second side panels 124 and 126. The dryer 110 additionally includes a back panel 128 and a movable door 130 for exposing an internal space (i.e. internal chamber) provided by the dryer 110, for inserting and removing hair additions into and out of the dryer 110. For example, a user may open the door 130 to access contents of the dryer 110. A movable second door 132 may also be provided on the dryer 110 to allow only a partial opening of the dryer 110 while the drying process is ongoing. It should be noted that, while the control interface 116 is illustrated as mounted in the second door 132, the control interface 116 may be mounted in the door 130 or on one of the other panels of the dryer 110. First and second handles 134 and 136 are provided on the door 130 and the second door 132, respectively, to facilitate opening and closing the doors against the pressure of sealing edges as described in more detail hereinbelow. The dryer 110 additionally includes a removable tray 176 having a base panel 178 and raised sides 180, 182 and 184 (a fourth raised side is also provided, but not shown). The removable tray 176 is provided to catch dripping moisture or liquid as well as any loose hairs or particles dislodged during the drying process. Pull handles 186 and 188 are provided on the tray 176 for ease of use.

The intake system 112 of the hair drying system 100 is provided to force air into and downward through the dryer 110. The intake system 112 generally includes a ducted intake fan 138 positioned in the top panel 120 of the dryer. The exhaust system 114 similarly is provided to draw air out of the dryer 110 and includes a ducted exhaust fan 140 positioned within another panel of the dryer, for example, as shown the exhaust fan 140 is positioned within the first side panel 124. The exhaust fan 140 is positioned adjacent to the bottom panel 122 of the dryer 110 such that air forced into the dryer at the top panel 120 by the intake fan 138, passes over a hair addition contained within the dryer 110 and is drawn out of the dryer 110 by the exhaust fan 140. In order to increase air flow through the dryer 110 and increase drying efficiency, additional intake fans, such as second and third intake fans 142 and 144 may be provided along with an additional second exhaust fan 146. The exhaust system 114 or the intake system 112 may include any appropriate configuration or device to cause air to flow vertically or parallel to a hanging hair addition. For example, referring to FIG. 2, the exhaust system 114 may additionally include third and fourth exhaust fans 166 and 168 positioned in the second side panel 126 and adjacent the bottom panel 122 to further assist in exhausting dampened air from within the dryer 110. Further, in some embodiments, only the intake system 112 includes a fan or other air forcing apparatus. For example, the exhaust system 114 may merely include one or more openings appropriately placed to cause air convection to flow generally vertically for drying hanging hair additions. In some embodiments, the intake or exhaust systems may include openings along a perimeter of the top and bottom panels, the openings synergistically configured to provide air flow for most effectively parallelly and downwardly passing air over hanging hair extensions. For example, parallelly and downwardly passing air passes parallelly over a length of a hanging hair addition unit. Referring to FIG. 3, the intake fan 138 and the second and third intake fans 142 and 144 are illustrated as being mounted in line across the top panel 120. Alternatively, the fans may be staggered across the top panel 120. More or fewer fans than shown are contemplated as is mounting some or all of them in the first and second side panels 124 and 126 or the back panel 128 at positions adjacent the top panel 120 to maintain the fans at the upper end of the internal chamber 222 of the dryer 110.

The intake system 112 of the hair drying system may include additional features to facilitate drying of the hair additions contained within the dryer 110. Heaters (not shown) may be incorporated into one or more of the intake fans 138, 142 and 144 to warm the air as it passes into the dryer 110. Alternatively, heaters may be provided directly within the dryer 110, or above or outside dryer 110 or the internal space provided by the dryer. Further, various air treatment systems may be incorporated into the intake system 112 to further assist in treating the hair additions. For example, ionizing and/or ozone generating units may be provided to reduce any residual odors in the hair additions as a result of the prior cleaning processes and to impart an overall fresh scent to the dried hair additions. In some embodiments, ionizing mechanisms or ultraviolet radiation may be included to dry wet hair additions.

The base 118 is provided to support the dryer 110 and generally includes a frame 148 having one or more drawers 150, 152 for retention of accessories as described hereinbelow. Pull knobs 154 and 156 are provided on the drawers 150 and 152, respectively, to facilitate opening and closing the drawers 150, 152. Legs 158, 160 and 162 (along with a fourth leg not shown) are provided to support the frame 148, as well as the dryer 110, above a floor. The bottom panel 122 of the dryer 110 rests on a top panel 164 of the frame 148 of the base 118 and may be secured thereto by bolts, etc. The dryer 110 and the base 118 may be formed from wood, plastics or metallic materials and the interior surfaces of the dryer 110 may be treated to reduce the growth of microorganisms or mold, or may include waxed or water-resistance or water-proof surfaces.

As shown in FIG. 2, internal support assemblies 170, 172 and 174, described more specifically below, are provided within the dryer 110 and serve to suspend hair additions (bulk or wefted) within the dryer 110 for drying. The dryer 110 may include one or a plurality of support assemblies. Further a support assembly may be specifically positioned or configured inside the dryer 110 such that vertically flowing air (i.e. parallel to the hair additions that may be hanging on the internal support assembly) may pass over hanging hair additions in a downward direction. For example, in some cases the intake and exhaust systems may be configured to create air convection that produces downwardly and vertically flowing air in a center or along sides of the dryer 110, and as such, the support assemblies may be placed in the center or sides of the dryer, respectively, where the flowing air may pass vertically and downwardly over hanging hair additions, to dry the hair extensions without causing the hair extensions to tangle. In some embodiments, the dryer 110 may include vertically elongated spaces, that are configured to contain or receive the support assemblies 170, 172, 174 individually, such that air flow (via intake system 112 and exhaust system 114) is substantially regulated and directed downward onto each support assembly, respectively. Such vertically elongated spaces may be separated by a barrier, or a porous material or membrane or diffuser material as further described below.

It should be noted that, during the drying process, the dryer 110 may be sealed to assure the flow of drying air from the intake system 112 to the exhaust system 114. The door 130 may be pivotally and sealingly mounted along and to the first side panel 124 along a first side edge 190 of the door 130 and a leading edge 192 of the first side panel. Similarly, a first side edge 194 of the second door 132 may be sealingly and pivotally mounted to a leading edge 196 of the second side panel 126. A top edge 198 of the door 130 may seal with a leading edge of the top panel 120 as does a top edge of the second door 132. Bottom edges 212 and 214 of the door 130 and the second door 132, respectively, may seal against a leading edge 216 of the bottom panel 122. Finally, when closed, second side edges 218 and 220 of the door 130 and the second door 132 seal against each other, respectively. Thus, the doors 130 and 132 along with the top, bottom and back panels 120, 122 and 128 and the first and second side panels 124 and 126 form a sealed internal chamber 222 within the dryer 110 for receipt and drying of hair additions.

As noted above, the base 118 contains drawers 150 and 152. Drawers 150 and 152 are movably mounted to the frame 148 of the base 118 by respective tracks 224 and 226 and define compartments for receipt of accessories used with the hair drying system 100 such as, for example, components of the internal support assemblies 170, 172, 174, etc. and other accessories or hair additions.

Figure 4:
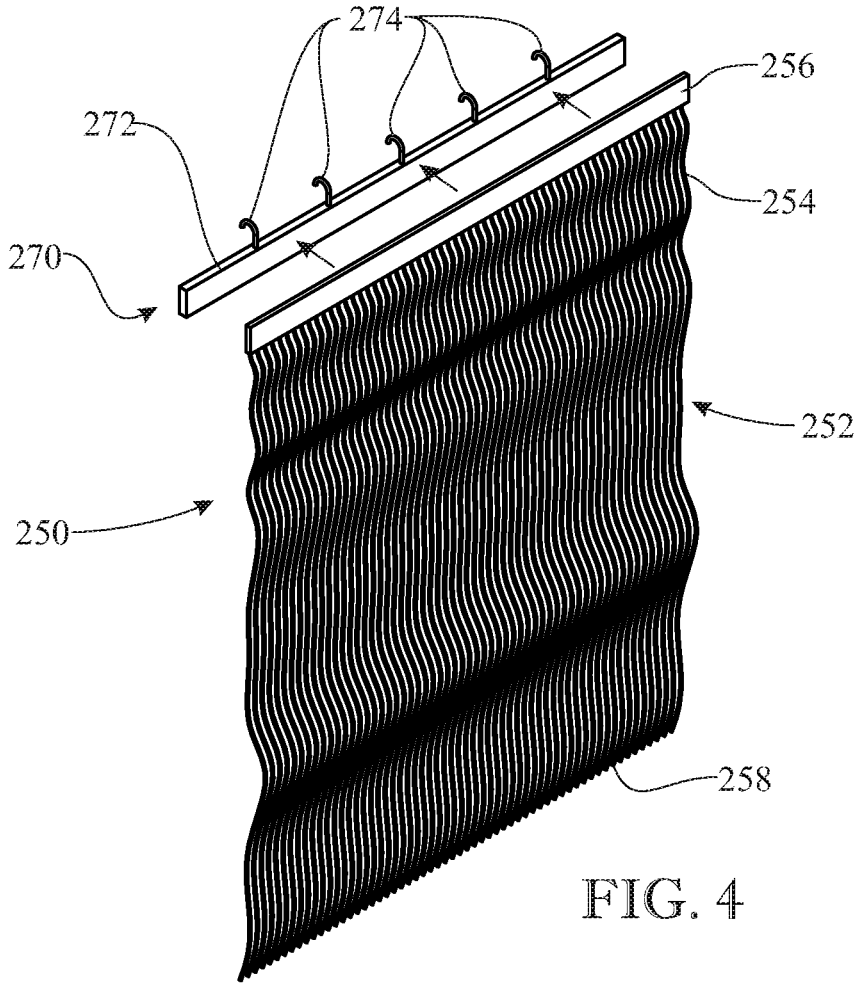
FIG. 4 presents an isometric view of a wefted hair addition and a first example of a hair addition support, in accordance with aspects of the invention.

Turning now to FIG. 4, there is illustrated a wefted hair addition 250 consisting of a plurality of longitudinal wet hair addition strands 252 attached at their first ends 254 in an array along a track or weft 256. The wefted hair addition 250 may be a unit of hair addition strands as described above, grouped together in any appropriate way. For example, the track or weft 256 may extend perpendicularly to lengths of wefted hair addition strands 252, when the strands hang freely downward. Second ends 258 of the hair addition strands 252 hang freely. A hair addition support 270 (e.g. weft support) is provided and generally includes a horizontal support member 272 and a plurality of hooks 274 extending from the support member 272. The weft 256 of the wefted hair addition 250 is temporarily attached to the support member 272 of the hooked hair addition support 270 by various known methods, such as, for example, tying with string or wire, clips, tape, temporary glue etc. The hooked hair addition support 270 supports the wefted hair addition 250 within the hair drying system 100 as described in more detail hereinbelow. It is to be understood that although hair addition 250 is shown wefted, a bulk or loose hair addition may be attached to the support member 272 via any appropriate attachment device known in the art (i.e. clips, string, temporary glue, etc.).

Figure 5:
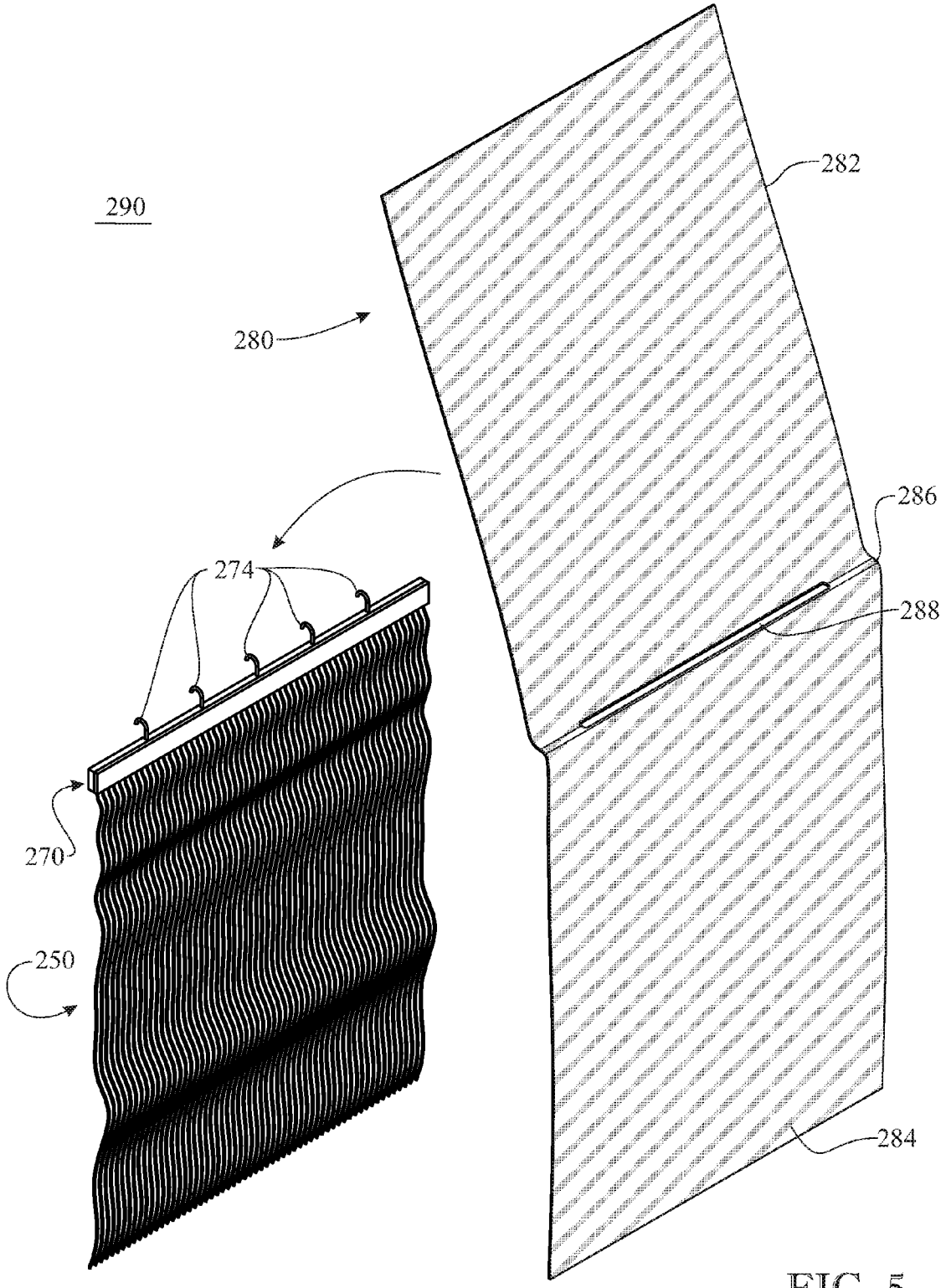
FIG. 5 presents an isometric view of a first example of a diffuser for covering the wefted hair addition and first example of the hair addition support, in accordance with aspects of the invention.

With reference to FIG. 5, there is disclosed a diffuser 280 for use in covering the assembled wefted hair addition 250 and hooked hair addition support 270. The diffuser 280 may be a porous sleeve including foam materials or air diffusing fabric. For example, the diffuser 280 may include typical materials found in hair dryer air diffusers, or foam covers for microphones. The diffuser 280 covers the wet wefted hair addition 250 during drying and helps control the amount of heat and air provided to the wefted hair addition 250 (via the intake and exhaust system described above) as well as helping maintain the hair addition strands 252 in a straight and untangled condition. The diffuser 280 generally includes first and second cover panels 282 and 284 joined along a center portion 286 of the diffuser 280. The cover panels 282 and 284 of the diffuser 280 may fold along the center portion 286. When the diffuser covers the wefted hair addition 250, the cover panels 282 and 284 may be substantially parallel as shown in FIG. 5. The center portion 286 is provided with a slot 288 to allow the hooks 274 of the support member 272 to pass through and facilitate suspending the entire assembly 290, consisting of the wefted hair addition 250, the support 270 and the diffuser 280, within the hair drying system 100. As an example, the diffuser may include materials such as foam, to diffuse air flowing through the sleeve and appropriately expose covered hair additions to heat and drying air. In some instances, the diffuser 280 itself may have radiative properties. For example, in response to heat or electromagnetic radiation, the diffuser 280 may become a radiative source or a black-body radiator. As another example, the diffuser 280 may include materials that emit electromagnetic radiation in response to being subjected to an outside electromagnetic source, the electromagnetic radiation having drying or heating properties. As another non-limiting example, the diffuser 280 may be provided in the form or shape of a bag or an umbrella. A diffuser may be configured for a particular hair type of material. For example, one diffuser may be configured for curly hair, and one diffuser may be configured for straight hair.

Figure 6:
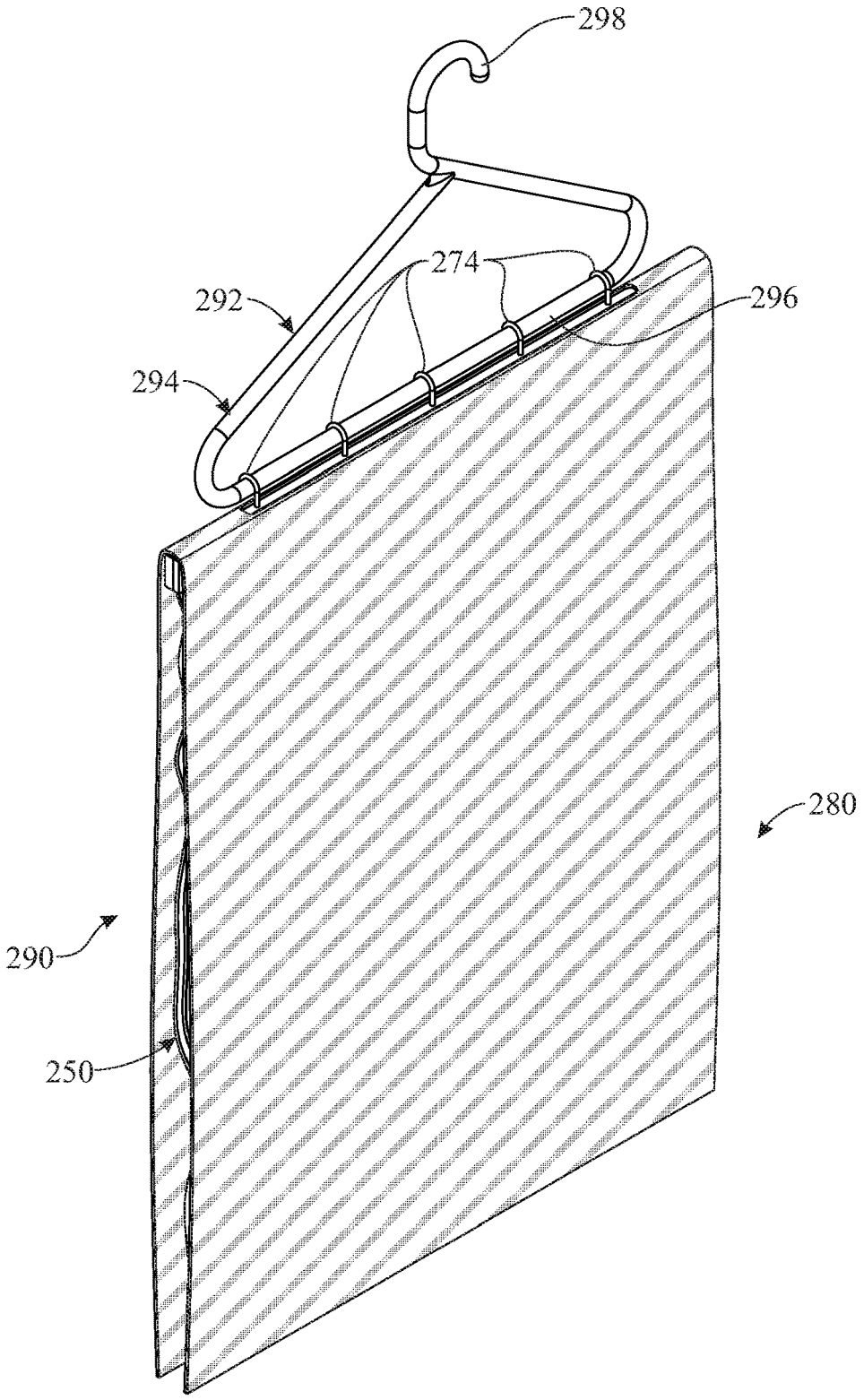
FIG. 6 presents an isometric view of the wefted hair addition and first example of the hair addition support covered by the first example of the diffuser and suspended from a hanger, in accordance with aspects of the invention.

Referring briefly to FIG. 6, the assembly 290 is shown suspended from a hanger 292 having a triangular body 294 including a horizontal member 296 and a hook 298. For example, the hanger 292 may be a common clothes hanger or a similar apparatus. Hooks 274 of the hooked hair addition support 270 are releasably hooked over the horizontal member 296 of the hanger, while the diffuser 280 covers the wefted hair addition 250.

Figure 7:
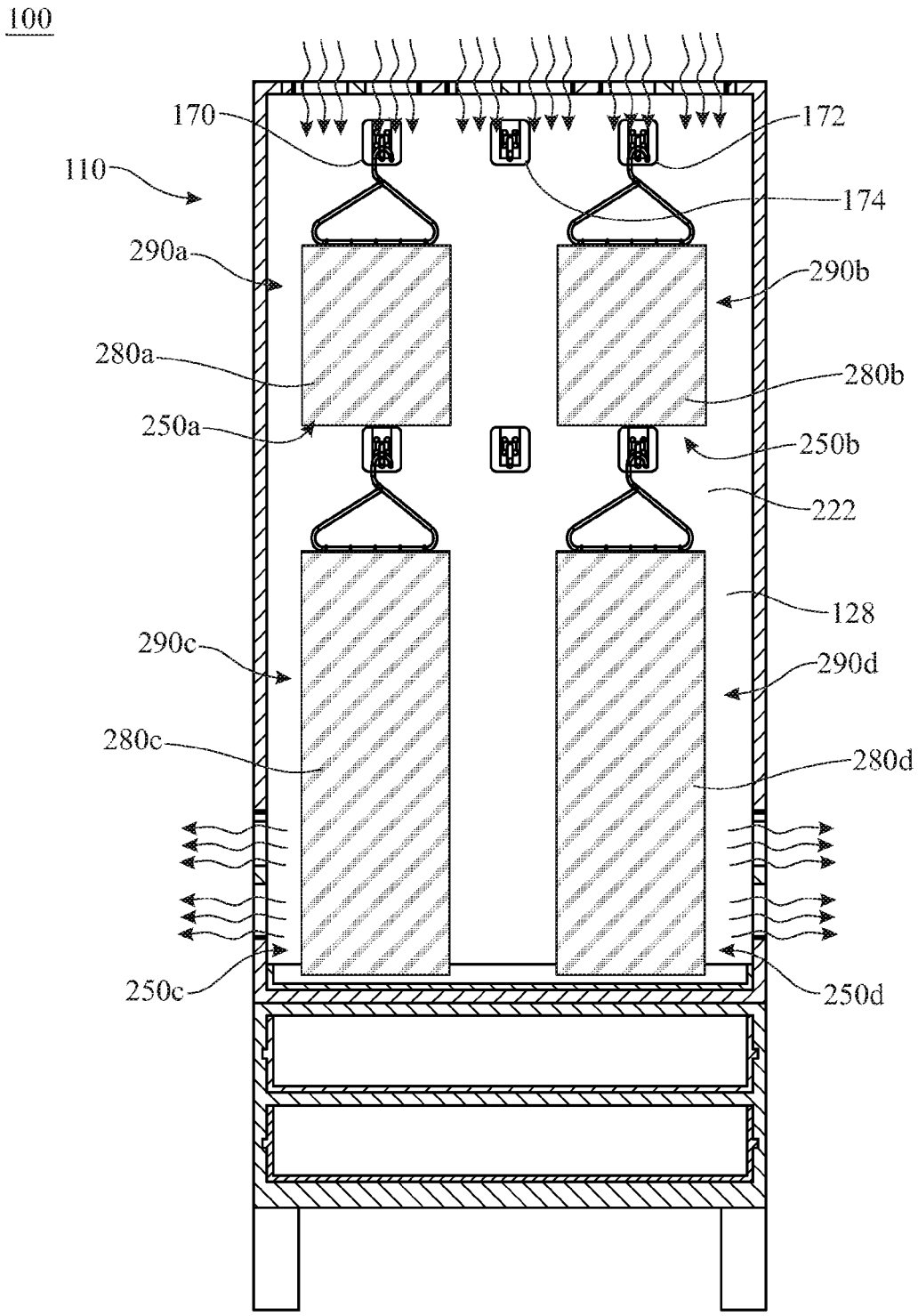
FIG. 7 presents a cross-sectional view, taken along line 7-7 of FIG. 3, illustrating the flow of drying air over suspended and covered wefted hair additions, in accordance with aspects of the invention.

Turning to FIG. 7, there are illustrated multiple assemblies 290*a-d* suspended within internal chamber 222 of the dryer 110 for drying. The multiple assemblies 290 *a-d* may include assemblies such as assemblies 290*a* and 290*c* which contain wet wefted hair additions 250*a* and 250*c* having differing lengths. The associated diffusers 280*a* and 280*c* also have differing lengths to properly cover and protect the respective wet wefted hair additions 250*a* and 250*c*. Alternatively, the assemblies 290*a-d* may contain wet wefted hair additions 250*a-d* having differing colors, textures, etc. The assemblies 290*a-d* are suspended within the internal chamber engagement of the hooks 298 of the hangers 292 with internal supports such as disclosed above as internal supports 170, 172, 174 etc. In some instances, the diffusers 280*a-d* may each have a unique color or appearance to distinguish contained hair additions. For example, one diffuser 280 may be blue to indicate the contents belonging to a particular hair salon client, and another diffuser 280 may be red to indicate contents belonging to another hair salon client. In some embodiments, the diffuser 280 may be appropriately transparent to show the contents of the diffuser 280, for identifying the contents belonging to a particular client or hair addition wearer.

Additionally or alternatively, lighting elements may be included to provide adequate visibility inside internal chamber 222. For example, various lighting elements such as light bulbs or LED or fluorescent lighting elements may be included to light the internal chamber 222 and provide visibility to a user. For example, the lighting elements may be configured to automatically illuminate when a door of the cabinet 110 is opened. Further, such lighting elements may be manually turned on via the control interface 116, or via any appropriate button or selector or switch.

It is to be understood that the internal support 170 is not limited to receiving or supporting wefted hair additions or assembly 290. For example, the internal support 170 may receive loose or bulk hair, grouped in any appropriate way as described above. Alternatively, the hair addition support 270 may be inserted into the dryer 110 without the hanger 292. For example, the hair addition support 270 may be directly hooked onto the internal support 170. Further, the hair additions may be inserted into the dryer 110 via the internal support 170 without the diffuser 280 covering the hair additions. A user may decide when to include the diffuser, and how to appropriately group the hair additions for inserting the additions into the dryer 110.

Figure 8:
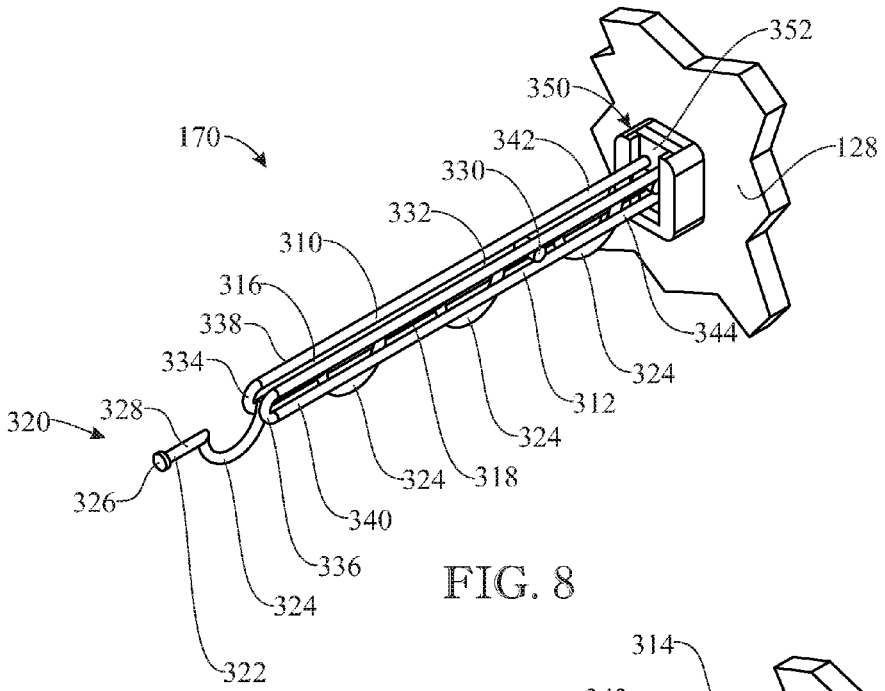
FIG. 8 presents an enlarged detail perspective view of a first example of an internal support assembly for use in suspending the wefted hair additions within the first example of the hair drying system, in accordance with aspects of the invention.
Figure 9:
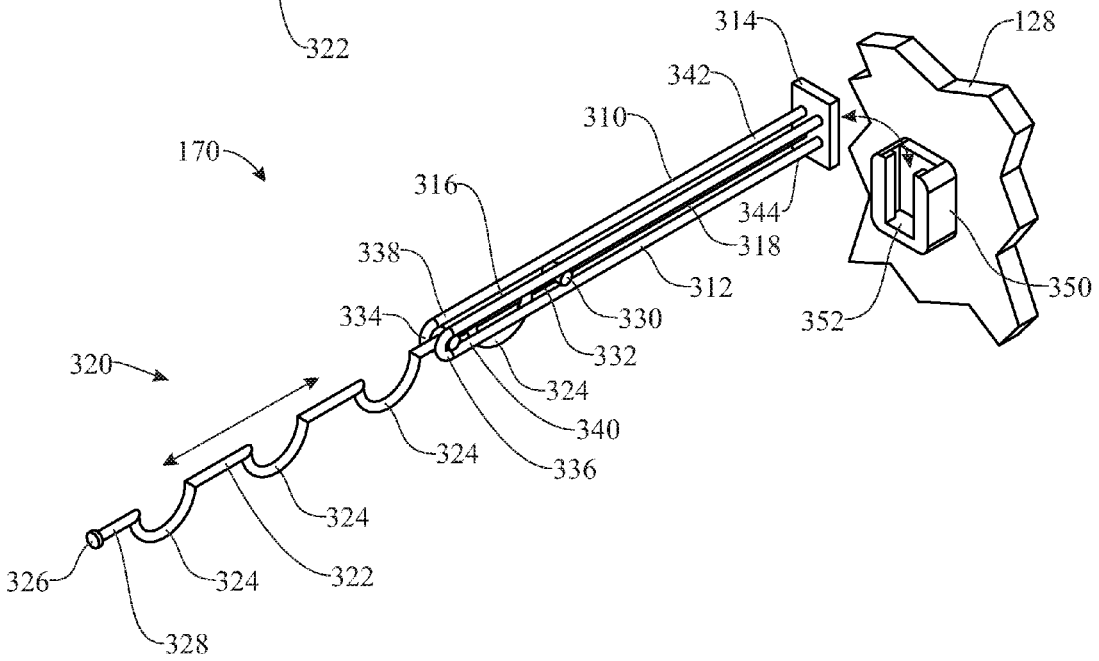
FIG. 9 presents an enlarged detail perspective view of the first example of the internal support assembly with parts separated, in accordance with aspects of the invention.

Referring now to FIGS. 8 and 9, the details of the internal supports, 170, 172 and 174 will now be described with respect to internal support 170; the details of the remaining internal supports are identical. The internal support 170 generally includes a pair of spaced apart, elongated and looped support bars 310 and 312 extending from a base plate 314. The looped support bar 310 defines a slot 316 and the looped support bar 312 defines a slot 318. A sliding member 320 is provided and includes a longitudinal bar 322 having a plurality of downwardly depending dips 324*a-d*. The dips 324*a-d* are provided to receive the hooks 298 of the hangers 292. A pull 326 is provided at a first end 328 of the longitudinal bar 322 and a stop or cross bar 330 is provided at a second end 332 of the longitudinal bar 322. The cross bar 330 is slidably captured within the slots 316 and 318 of the looped support bars 310 and 312. There may be one or a plurality of cross bars such as cross bar 330 between the dips or on the longitudinal bar 322 to support the sliding member 320 in a horizontal fashion for hanging hair additions. Curved ends 334 and 336 of the looped support bars 310 and 312 prevent the crossbar 330 from coming out of the slots 316 and 318 at respective first end 338 and 340 of the looped support bars 316 and 318 while the base plate 314 prevents the cross bar 330 from falling out of second ends 342 and 344 of the looped support bars. The second ends 342 and 344 extend from and are connected to the base plate 314. In some embodiments, the sliding member 320 and/or the looped support bars 310 and 312 may be configured to completely slide the sliding member 320 out of the support bars 310 and 312 to remove the sliding member 320.

The dryer 110 is provided with mounts 350 having an internal channel 352 to receive and support the internal supports 170. Specifically, the base plate 314 is removably received within the channel 352 of the mount 350. The mounts 350 may be provided on the back panel 128 of the dryer or may be provided on the first and/or second side panels 124 and 126 of the dryer 110.

Referring now to FIGS. 1,2 and 5-9 and initially with regard to FIGS. 5 and 6, exemplary of the hair drying system 100 will now be described. Initially, the diffuser 280 is positioned over connected wet wefted hair addition 250 and hooked hair addition support 270 (FIG. 5) and the assembly 290 is attached to the hanger 292 by hooking the hooks 274 of the hair addition support 270 over the horizontal member 296 of the hanger 292 (FIG. 6).

Referring to FIGS. 8 and 9, the sliding member 320 of the internal support 170 is pulled out through the looped support bars 310 and 312 to expose the dips 324 on the sliding member 320. Thereafter the hooks 298 of the hangers 292 are positioned over the dips 324 and the sliding member 320 is slid back to capture the hangers 292 on the internal supports 170. This suspends the various assemblies 290*a-d* within the internal chamber 222 of the dryer 110 and places the wet wefted hair additions 250 in a position to be dried.

Doors 130 and 132 are closed (FIGS. 1 and 2) to seal or enclose the internal chamber 222 and the control interface 116 is actuated to cause the intake system 112 to force drying air into the internal chamber 222 from the top of the internal chamber 222 and the exhaust system 114 to withdraw cooled and damper air out of the internal chamber 222 at the bottom of the internal chamber 222.

With specific reference to FIG. 7, an important feature of the disclosed hair drying system 100 is that the air flow through the internal chamber 222, and thus across the longitudinally hanging hair addition strands 252, is a unidirectional and laminar flow passing lengthwise from top to bottom across the hair addition strands 252 which keeps the individual hair addition strands 252 straight and prevents tangling as would possibly occur if the air flow was turbulent within the internal chamber 222. Thus, by providing the hair drying system 100 with intake and exhaust systems, 112 and 114, respectively at opposite ends of the internal chamber, even drying and avoidance of tangling the drying hair is achieved.

It is to be understood that any appropriate structure may be included to provide a slot for receiving the sliding member 320 or a hair addition. Opening the main doors 130 and 132 may let heat or air escape, reducing the drying effectiveness of the system 100. As such, in place of the doors, or in augmentation, the dryer 110 may include one or a plurality of slots on an outside panel configured to receive the sliding member 320 and an attached hair addition, such as wefted hair addition 250 and diffuser 280, or assembly 290. In this way, the dryer 110 may include client-representative numbers or tags on the slots to define which slot the client's hair addition is placed in. Such slots may extend inside the dryer 110 via an inwardly extending channel or space. In some embodiments, the diffuser 280 may instead be located inside each slot or channel, in instances where the slots extend inward toward the cavity formed by the dryer 110, where the diffuser 280 covers walls of the slot or channel, the walls defining individual slots and separating other slots, the other slots configured for receiving other individual hair additions or assemblies 290. In some embodiments, such slots may merely be provided as a narrow and vertical door configured to receive hanging hair additions. As such, the dryer 110 may include a plurality or array of rectangular or parallelepiped volume channels or spaces, each channel configured to receive a hair addition as described above. The channels may be separated from each other via a diffuser 280, for example. The slots may include individual doors for each slot, such that after a hair addition is inserted or removed, a respective individual door may be closed to maintain an ideal drying environment inside the dryer 110 by keeping heat and air from escaping the dryer 110. In some embodiments, the sliding member 320 may include a panel configured to seal the slot or channel when the sliding member 320 is fully received in a respective slot or channel. As such, main front panels of the dryer 110 may not need to be opened to remove a particular client's hair addition, since only a respective sliding member 320 would need to be removed from its respective individual slot. In some embodiments, the dryer 110 may include a plurality of vertically oriented trays and tray receiving or supporting structures to receive hair extensions, the trays may be separated by diffusers, and each tray may be configured for holding an individual client's hair addition unit, with or without including a diffuser on the hair addition unit.

In some embodiments, timers may be located near each slot, or via control interface 116 to indicate when a hair addition is ready to be removed. For example, the hair drying system may include an auditory alarm which emits a sound (e.g. via a speaker) to alarm or alert a user in response to the timer running out of time. Various indicator lights may also be operative with the timer to visually indicate that the timer has run out of time. Further, a smoke alarm may also be included. In some embodiments, the system may include wireless networking to send messages to a wireless device such as a mobile phone for reminding a user that a hair addition is dry. Further, in some embodiments, temperature sensors may be included in each of the above described slots, supports, vertical trays or diffusers to determine, sense and read out a temperature of a hair addition or its immediate environment. Such a temperature sensor may also send signals via a wireless network to a personal device such as a mobile computing device to provide a temperature readout to a remote user.

Figure 10:
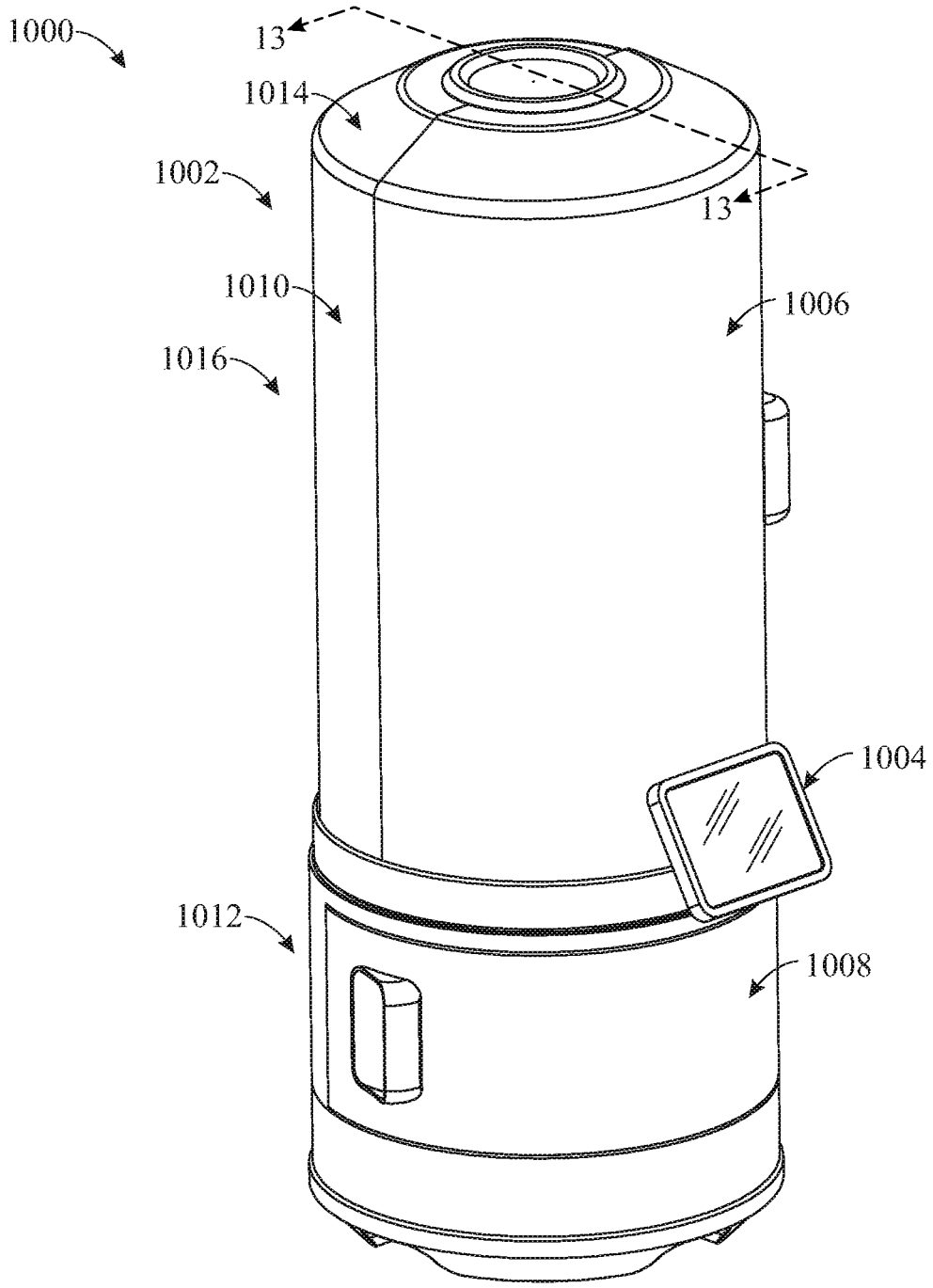
FIG. 10 presents a perspective view of a second example of a hair drying system, in accordance with aspects of the present invention.
Figure 14:
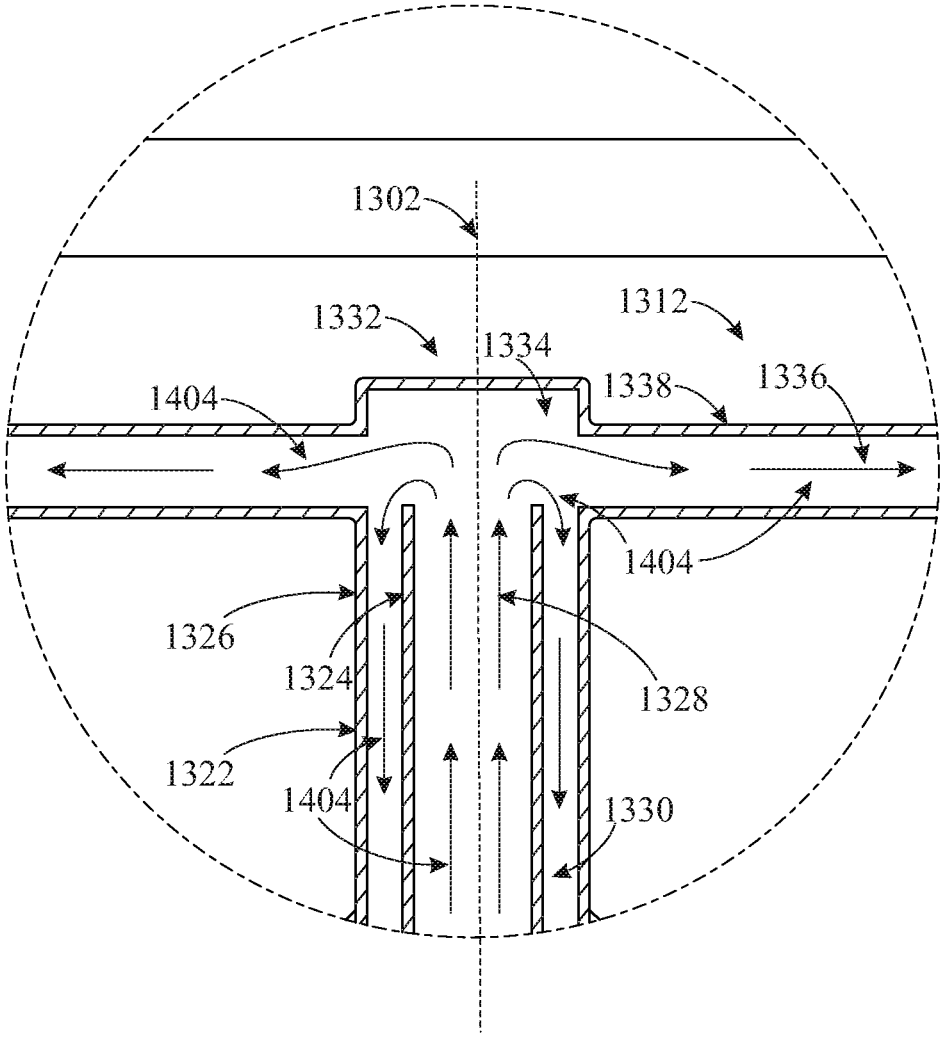
FIG. 14 presents a detailed view of detail 5 of FIG. 13, in accordance with aspects of the present invention.
Figure 15:
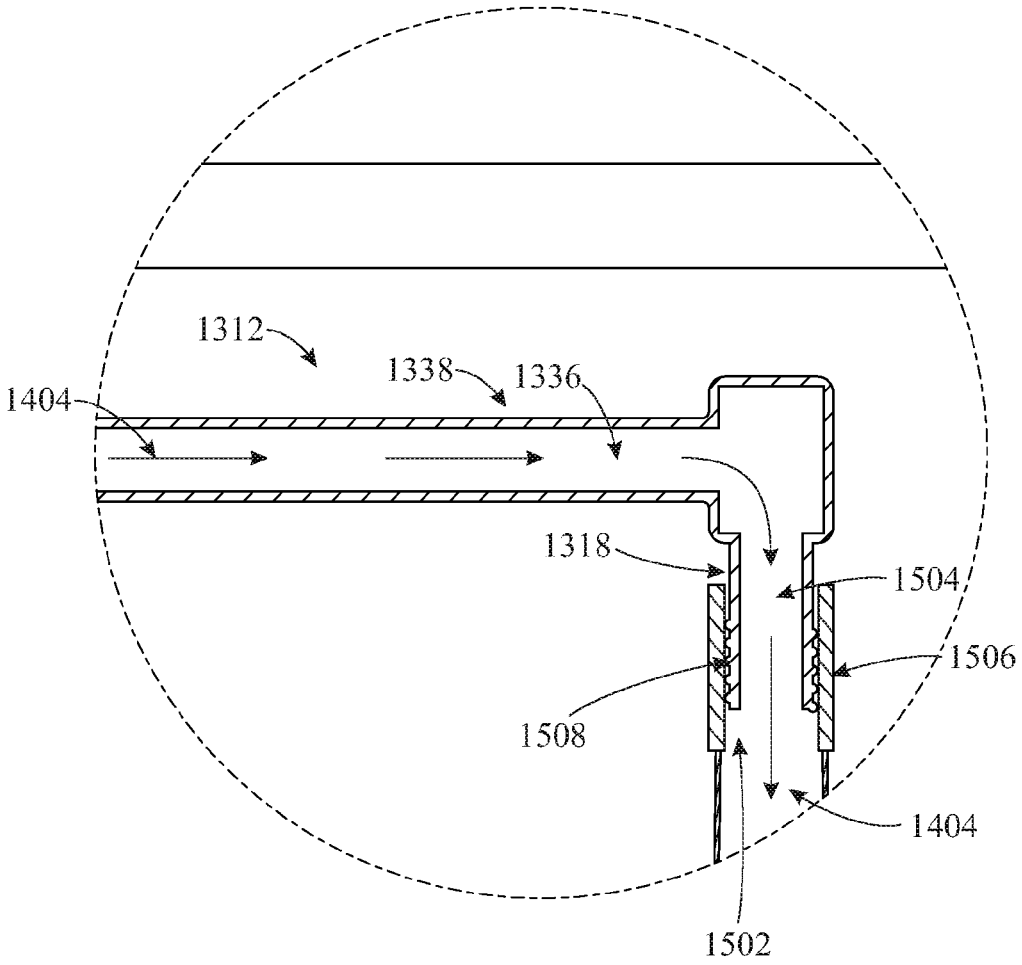
FIG. 15 presents a detailed view of detail 6 in FIG. 13, in accordance with aspects of the present invention.
Figure 16:
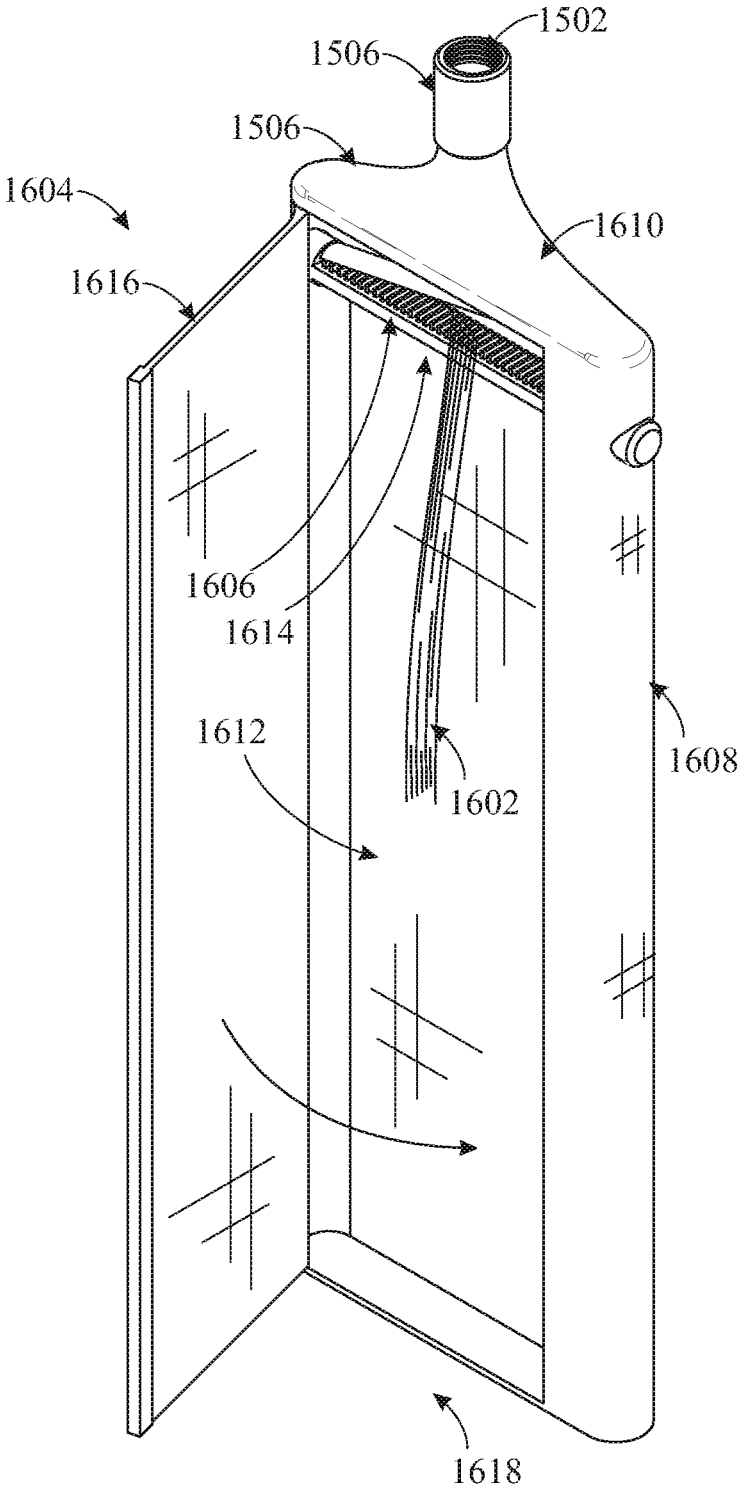
FIG. 16 presents an isometric front top view of a second example of a diffuser and a second example of a hair addition support, in accordance with aspects of the present invention.
Figure 17:
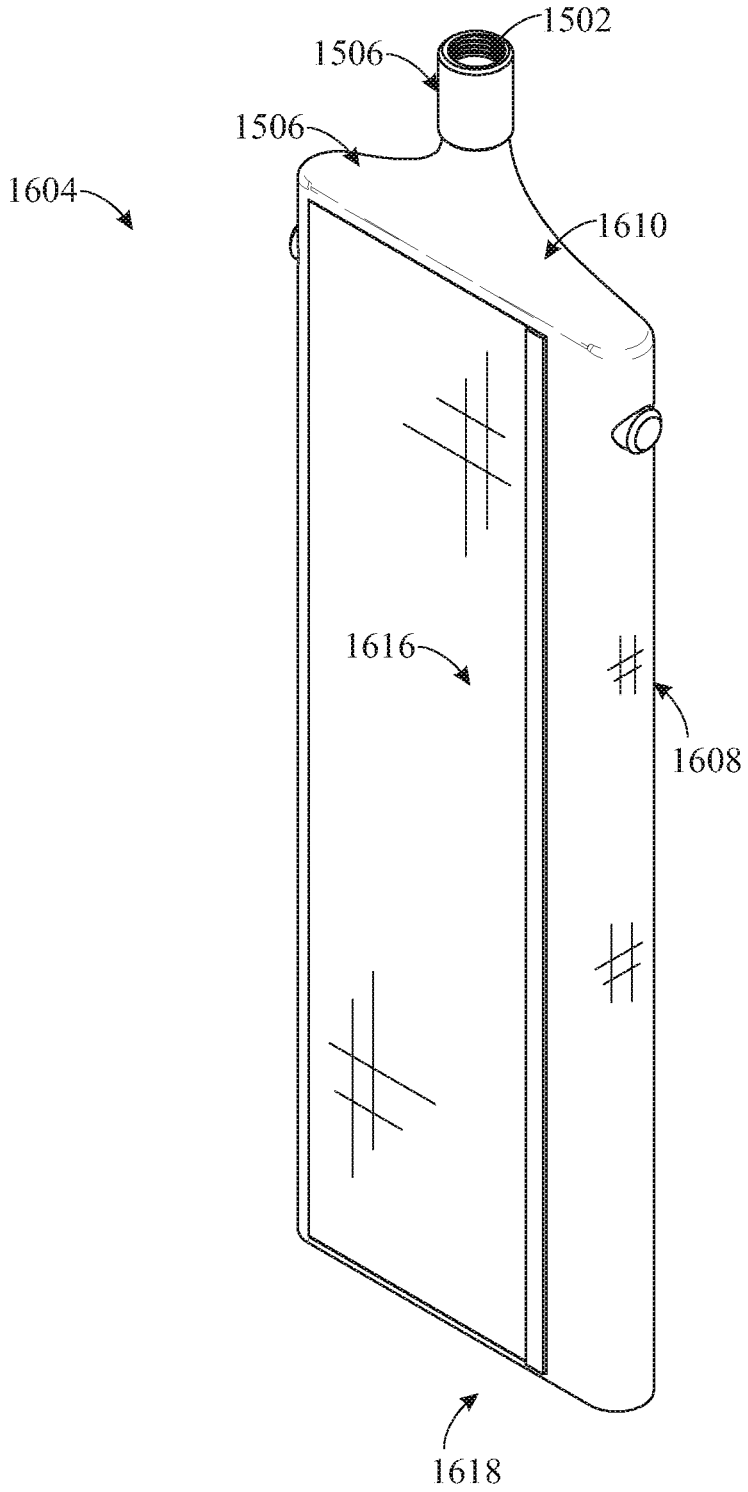
FIG. 17 presents an isometric front top view of the second example of the diffuser having a closed door, in accordance with aspects of the present invention.
Figure 18:
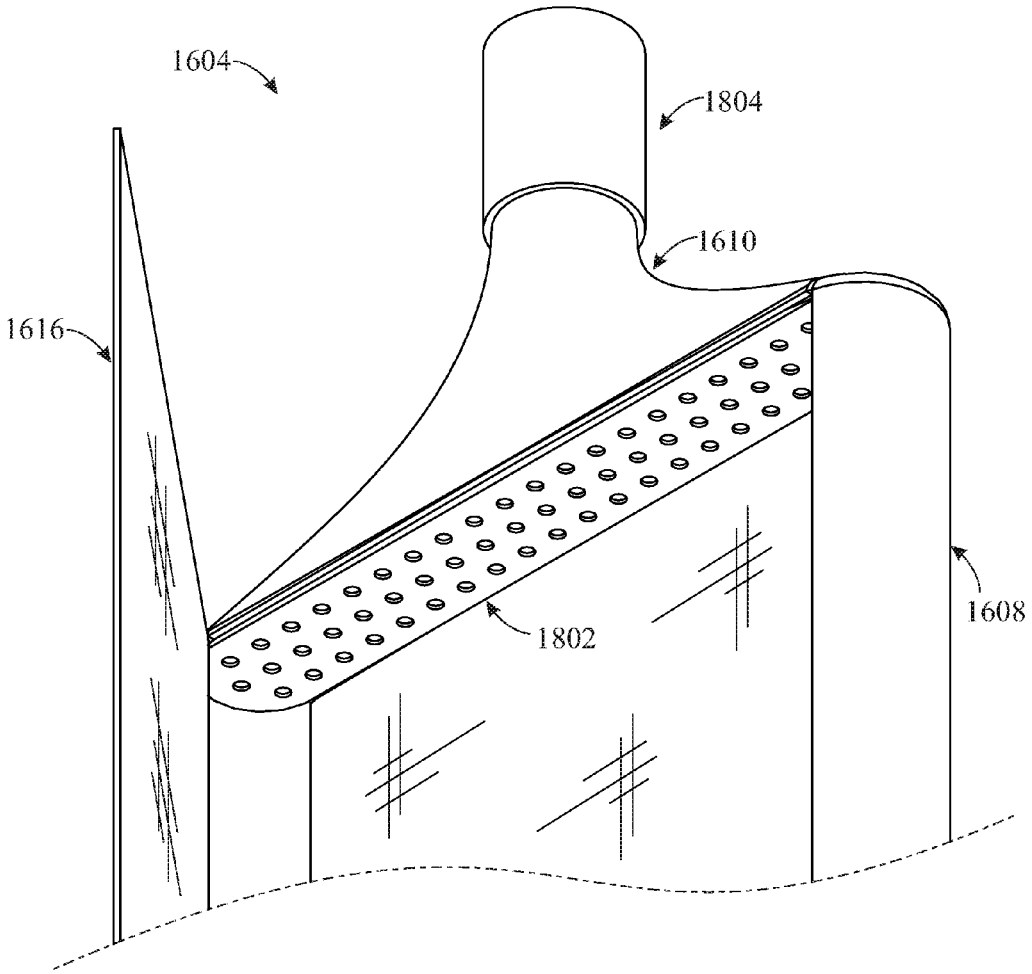
FIG. 18 presents a partial perspective view of a third example of a diffuser, in accordance with aspects of the present invention.
Figure 19:
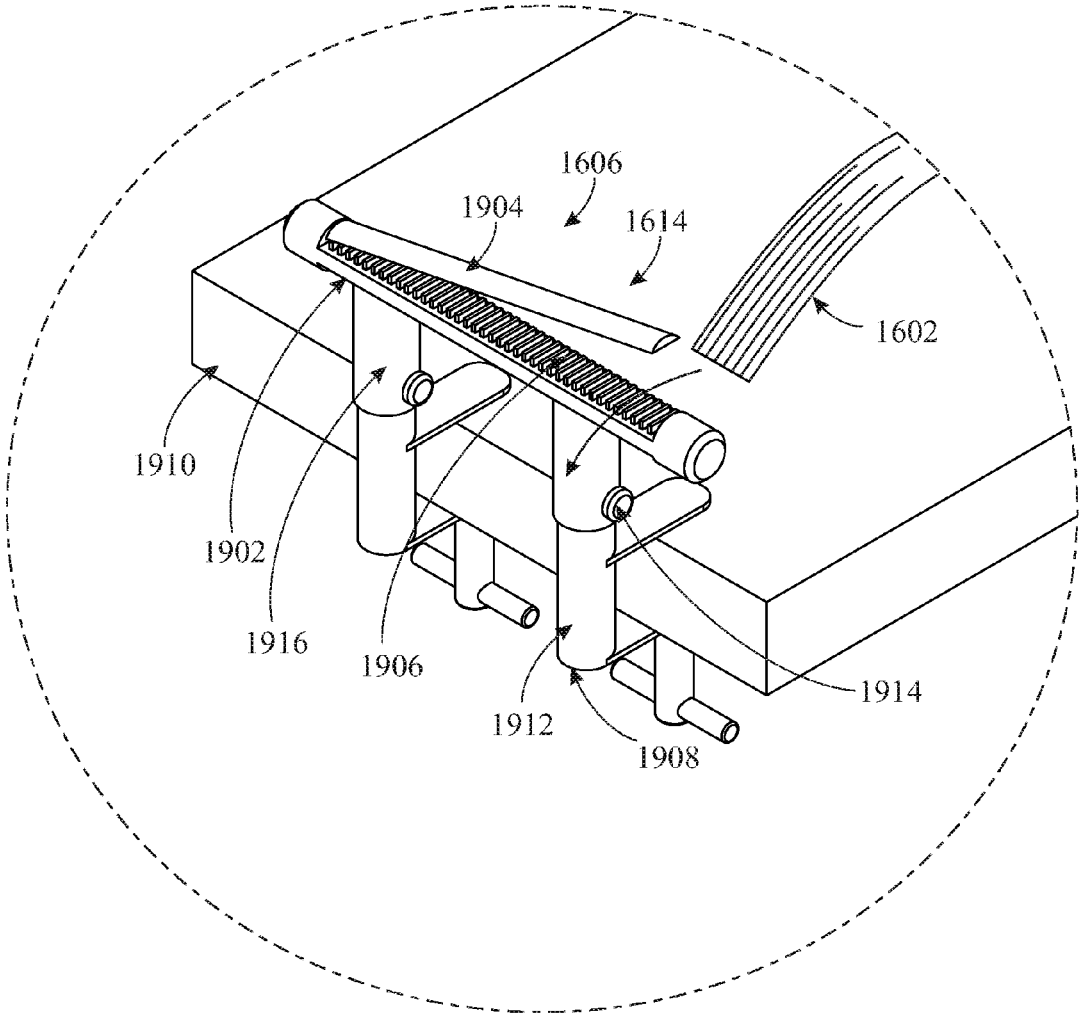
FIG. 19 presents a third example of a hair addition support, in accordance with aspects of the present invention.
Figure 20:
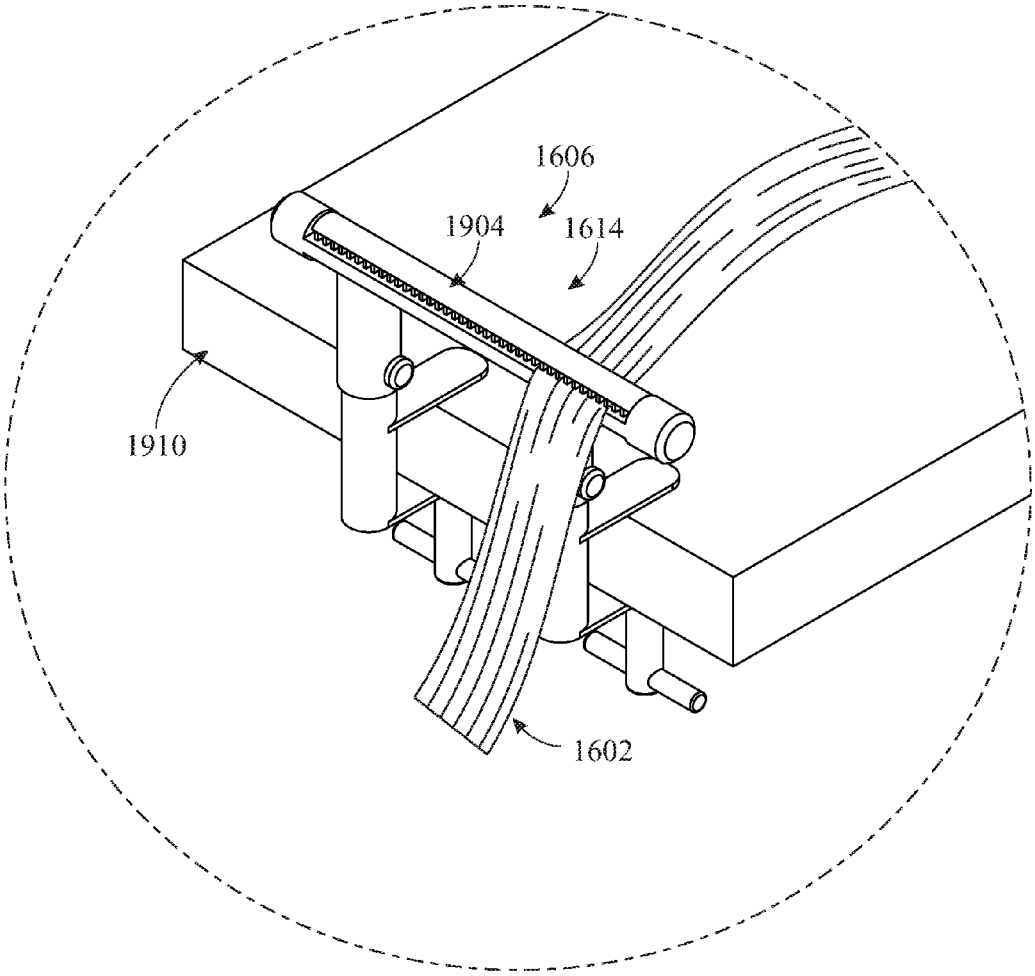
FIG. 20 presents the third example of the hair addition support of FIG. 19 in a closed state holding a hair addition, in accordance with aspects of the present invention.

The illustrations of FIGS. 10-20 show various examples of the hair drying system and of its components, structures and features. For example, FIG. 10 presents a second example of a hair drying system, FIG. 16 presents a second example of a diffuser and a second example of a hair addition support, FIG. 18 presents a third example of a diffuser, and FIGS. 19-20 present a third example of a hair addition support. As shown in FIGS. 16-18, the second example of the diffuser, second example of the hair addition support, and/or the third example of the diffuser may be in combination referred to as a diffuser assembly. Such a diffuser assembly is described in more detail below as diffuser assembly 1604, where the entire diffuser assembly 1604 may be hung from a support inside a drying chamber of the hair drying system. It is to be understood that the second example of the hair addition support of FIGS. 16 and 19-20 may include a clip 1606 and is described in more detail below. For example, to suspend a hair addition, a clip 1606 may be included in the hair drying system 100 (above described) or 1000 instead of hair addition support 270 (above described).

The second example of the hair drying system 1000 of FIG. 10 will now be described in detail. It is to be understood that like elements, structures, and functions described above and/or shown in FIGS. 1-9 may apply to the like elements, structures and functions described with respect to FIGS. 10-20 and vice-versa. For example, the above described support structures or elements, diffusers, and air intake and exhaust elements, may be included in hair drying system 1000. The various support structures or elements, diffusers, and the air flow system of hair drying system 1000 may be included in hair drying system 100 (above)

Figure 11:
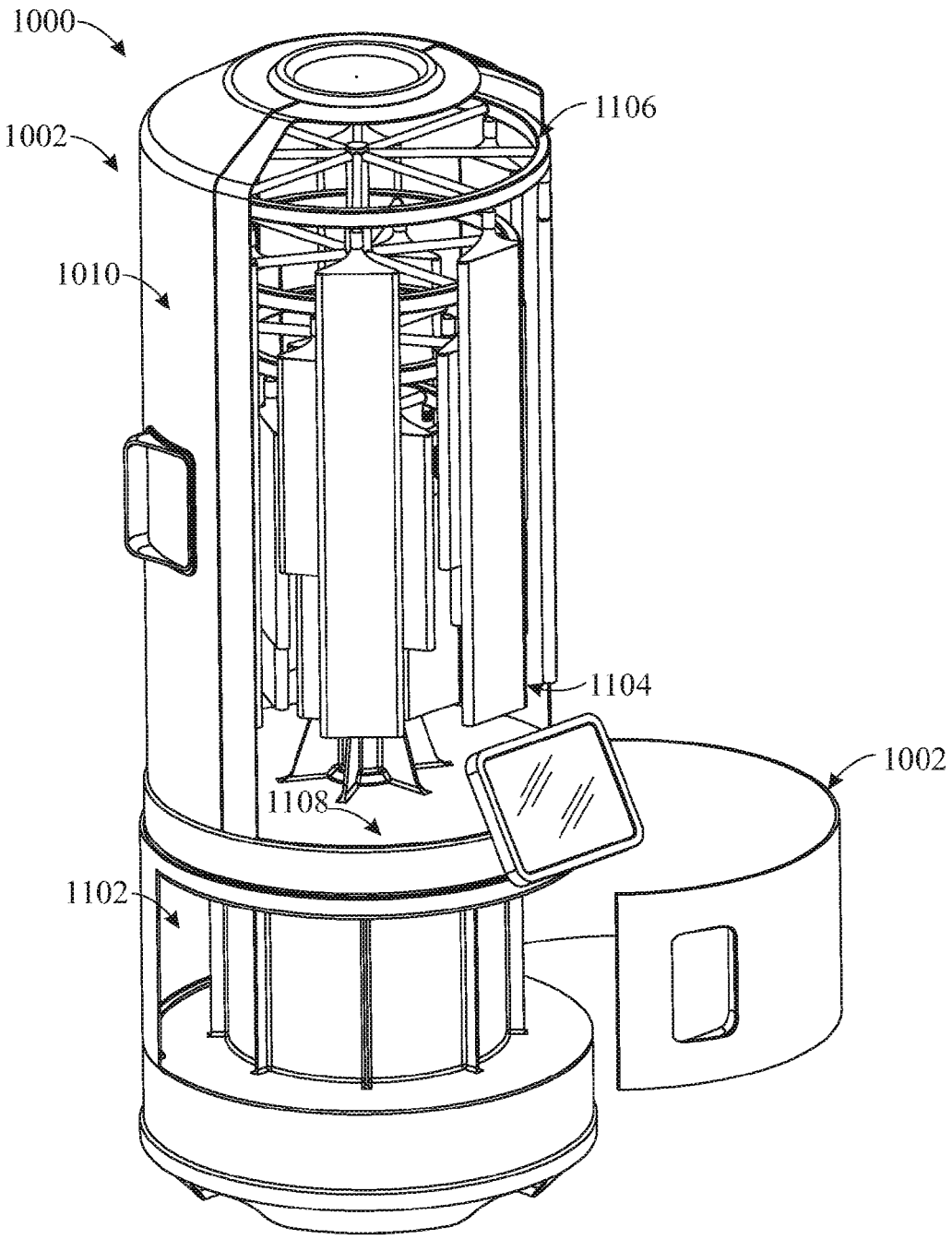
FIG. 11 presents a perspective view of the second example of the hair drying system, where internal components are shown, in accordance with aspects of the present invention.
Figure 12:
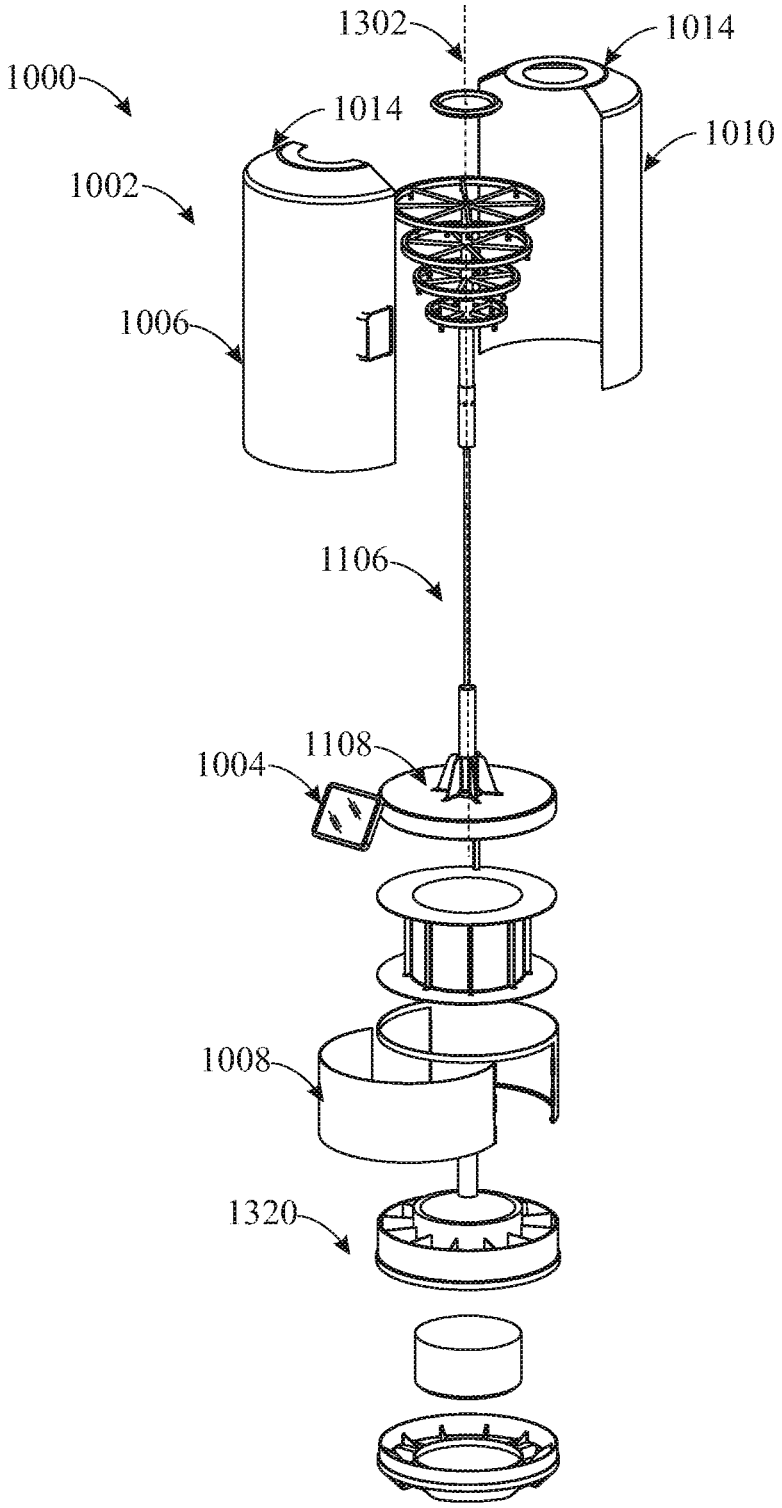
FIG. 12 presents a perspective view of the second example of the hair drying system with parts separated, in accordance with aspects of the present invention.
Figure 13:
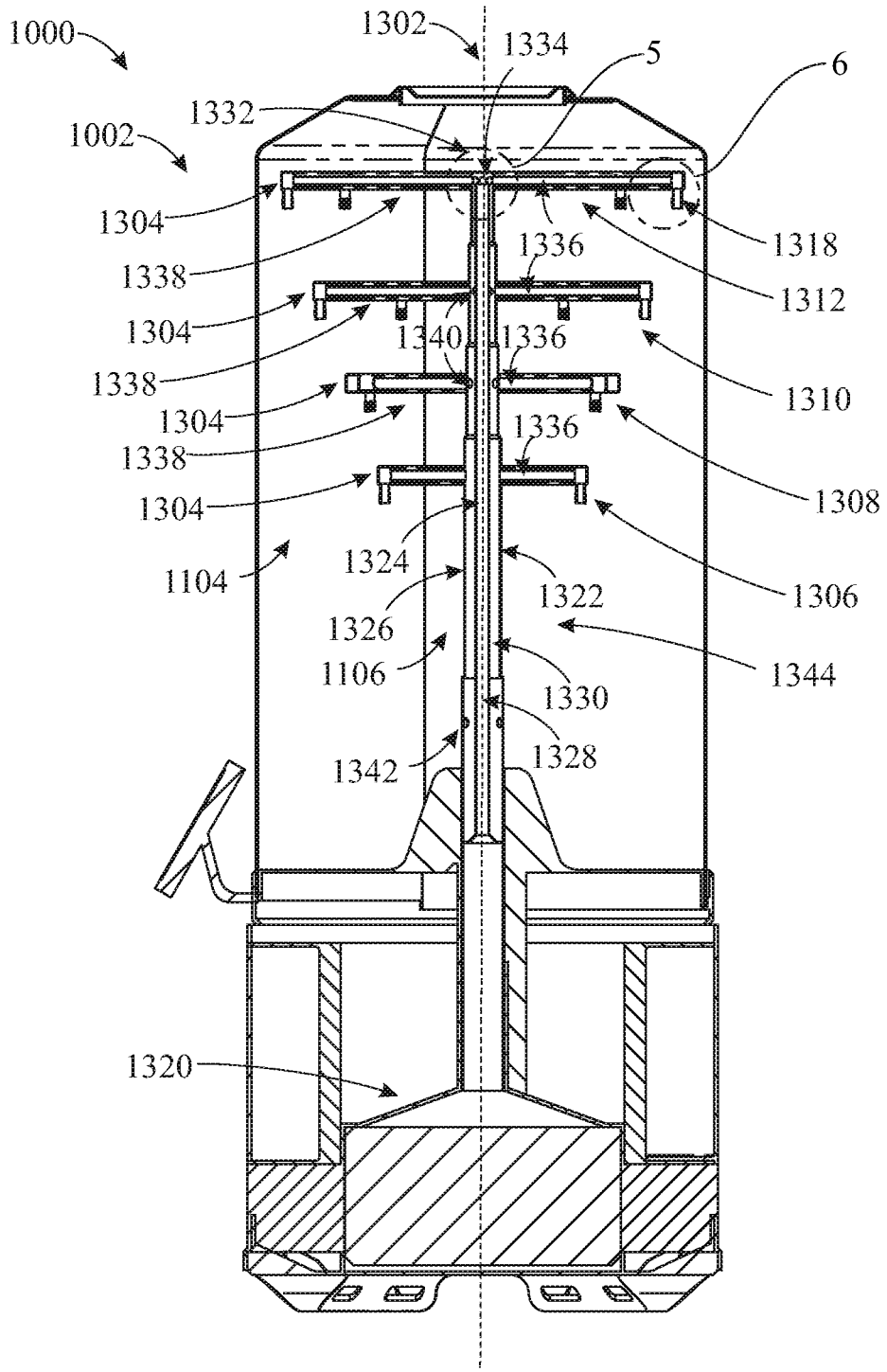
FIG. 13 presents a cross sectional elevation view showing internal components of the second example of the hair drying system, where the cross section is taken along sectional line 13-13 in FIG. 10, in accordance with aspects of the present invention.

Drying system 1000 includes a dryer 1002 defining an internal drying chamber 1104. FIGS. 11-13 show the drying system 1000 including an internal support assembly 1106 that is configured to support a hair addition 1602 in the internal drying chamber 1104 as a supported hair addition 1602 (FIG. 16). For example, a supported hair addition 1602 and/or a diffuser assembly 1604 may be loosely hung from the internal support assembly 1106 in a generally vertical orientation due to Earth's gravity. The drying system 1000 further may include an air flow system 1344 configured to provide flowing air 1404 (FIGS. 14 and 15) to a supported hair addition 1602 for drying the hair addition 1602.

Turning back to FIGS. 10-11, the drying system 1000 includes a control interface 1004 for controlling various parameters for drying supported hair additions 1602. For example, control interface 1004 may include or provide the functionalities described above with respect to control interface 116. The control interface 1004 may control the air flow system 1344. For example, in response to particular user input, the temperature of air flow, air flow velocity, and air flow flux inside the dryer may be controlled. As such temperature sensors may be located in one or more components of the diffuser assemblies 1604 or internal support assembly 1106 that provides temperature data to the control interface. Other parameters such as air humidity or air quality inside the dryer may be sensed and provided to a user via the control interface 1004. It is to be understood that the control interface 1004 may be controllable wirelessly via a remote device such as a smart phone or remote control over wi-fi, Bluetooth, or other wireless network technology.

The dryer 1002 may include a door 1006 that is configured to selectively open and close for exposing the internal drying chamber 1104 and the internal support assembly 1106 for allowing a user to insert, place and remove hair additions 1602 on or from the internal support assembly 1106. For example, a user may open the door 1006 to place the hair addition 1602 or the diffuser assembly 1604 on the internal support assembly 1106 and then close the door 1006 to allow the hair addition 1602 to dry in the internal drying chamber 1104. Once the user desires to remove the hair addition 1602 or the diffuser assembly 1604, or when the hair addition 1602 is dry, the user may open the door 1006 and remove the hair addition 1602 or diffuser assembly 1604 accordingly. For example, the door 1006 may slide open and closed.

The dryer 1002 and/or the internal drying chamber 1104 may be generally cylindrical in shape. The door 1006 may be curved to match the cylindrical circumference of the dryer 1002 and/or the internal drying chamber 1104 such that the door 1006 slides inside or outside curved walls of the internal drying chamber 1104 (e.g. by hugging a wall of the internal drying chamber 1104). For example the door 1006 may have approximately the same radius of curvature of the cylindrical shape such that the door 1006 may slide open and closed without internally or externally projecting from the dryer 1002 and the internal drying chamber 1104. In some embodiments, the door 1006 in a closed state provides half of a total tubular or cylindrical surface area for encapsulating the internal drying chamber 1104. For example, the door 1006 may have a 180 degree curve to horizontally cover the internal chamber in a closed state. As such, the dryer 1002 may include a body 1010 that is fixed relative to the internal drying chamber 1104, and the door 1006 in combination with the body 1010 may completely encapsulate the internal drying chamber 1104 (e.g. when the door is in the closed state). The door 1006 may be slidably fixed to the body 1010 for opening and closing the internal drying chamber 1104.

The dryer 1002 may include a base portion 1012 that supports the internal drying chamber 1104. The door 1006 may be slidably fixed to the base portion 1012. The base portion 1012 may include a base compartment 1102 that is accessible to store various items. The base portion 1012 may include a base door 1008 that may be openable and closable for a user to selectively access the base compartment 1102. The base door 1008 may slide open and closed and/or as shown in FIG. 11 the base door 1008 may be hinged at one end of the base door 1008. It is contemplated that a locking mechanism may be included for locking any of the herein described doors. The base may provide a floor 1108 that may combine with the body 1010 and the door 1006 to encapsulate the internal drying chamber 1104. Further, the body 1010 may include a top surface 1014 that covers a top of the internal drying chamber 1104.

In some embodiments surfaces that define the internal drying chamber 1104 (e.g. body 1010 and/or door 1006 and/or floor 1108) of the internal drying chamber 1104 or generally an upper portion 1016 of the dryer that is supported by the base portion 1012 may rotate on top of the base portion 1012. For example, the upper portion 1016 may rotate about a central vertical axis (e.g. axis 1302) of the base portion 1012. For example, the above described body 1010 may rotate about axis 1302. The door 1006 may slide or rotate about axis 1302.

As shown in FIGS. 11 and 12, the internal support assembly 1106 may include one or more horizontally oriented support wheels 1304 that are vertically elevated. A support wheel 1304 may support or suspend one or more hair additions 1602 and/or diffuser assemblies 1604. For example, the second example of the hair addition support 1606, the second example of the diffuser 1608, and/or the third example of the diffuser 1608 may be supported or suspended on a support wheel 1304 via attachment 1506 shown in FIGS. 13 and 16. The attachment 1506 is configured to removably attach to an attachment point 1318 on the support wheel 1304. The support wheel 1304 may support and suspend the diffuser assembly 1604 from the attachment points 1318 via the attachment 1506.

The support wheels 1304 may be configured to individually and independently rotate about an axis 1302 shown in FIG. 13. For example, a user may rotate a support wheel 1304 clockwise or counter-clockwise to subsequently rotate attached hair additions 1602 or diffuser assemblies 1604 to access hair additions that are not immediately proximate to the door 1006 or out of reach. Alternatively the support wheels 1304 may be fixed to the internal support assembly and be un-rotatable.

The internal support assembly 1106 may include a plurality of support wheels 1304 that have varying radii, and each support wheel may be disposed in a stacked configuration as shown in FIG. 13, where central axes or central points of the support wheels are co-linear with one another or co-linear with axis 1302. For example, a lowest, first support wheel 1306 may have a radius R1, a second support wheel 1308 disposed immediately and consecutively above the first support wheel 1306 may a radius R2 greater than R1, a third support wheel 1310 disposed immediately and consecutively above the second support wheel 1308 may have a radius R3 greater than R2, and a fourth support wheel 1312 disposed immediately and consecutively above the third support wheel 1310 may have a radius R4 greater than R3 and so forth, the internal support assembly 1106 having any number of support wheels.

Hair additions 1602 or diffuser assemblies 1604 may be hung in an arrangement from the plurality of support wheels 1304 such that the hair additions 1602 or diffuser assemblies 1604 do not interfere or contact one another when hung and/or during 360 degrees of rotation when the support wheels 1304 are rotated with respect to one another.

Each support wheel 1304 may include one or more attachment points 1318. The attachment points 1318 are configured to receive attachments 1506 of diffuser assemblies 1604 for suspending the diffuser assemblies 1604. The attachment points 1318 for each support wheel 1304 may be disposed at different attachment point distances from a center of each support wheel 1304 to maintain separation between the diffuser assemblies 1604 and to provide even airflow to the diffuser assemblies 1604 for evenly drying hair additions contained in the internal drying chamber 1104. For example, an attachment point distance may be a distance between a center of a support wheel and an attachment point 1318 on that support wheel, and larger-radius support wheels may have attachment point distances that are greater than attachment point distances in smaller-radius support wheels. As can be seen in FIGS. 12 and 13, the attachment point distance for the first support wheel 1306 (smaller radius) is lesser than the attachment point distance for the second support wheel 1308 (larger radius). As can be seen in FIGS. 13 and 15, the attachment points 1318 may be located near a distal or terminal circumference of a support wheel 1304. As such, when the diffuser assemblies 1604 are hung on multiple support wheels, the diffuser assemblies 1604 are concentrically arranged one behind another in a vertically staggered or stacked manner.

The air flow system 1344 will now be further described. The air flow system 1344 may include an air flow generator 1320 located near a bottom of the dryer 1002, or inside the base portion 1012. For example, the air flow generator 1320 may include various fans, turbines, and/or motors to create air flow or convection, and this air flow may be directed to the supported hair additions 1602 via the air flow system 1344. The air flow generator 1320 may include a heater to heat the generated air flow. It is to be understood that the below described channels and/or tubes may be heated to heat the air flow generated by the air flow generator for drying the hair additions.

The air flow generator 1320 may generate air flow 1404 (FIGS. 14 and 15) and the air flow 1404 may be directed through various tubes or channels to be applied to supported or hung hair additions 1602 or diffuser assemblies 1604. For example, a vertical tube 1322 may extend centrally upward along axis 1302, extending from air flow generator 1320. The vertical tube 1322 may include two walls, first channel wall 1324 and second channel wall 1326, which define concentric channels. For example, the concentric channels may be inner channel 1328 and outer channel 1330 defined by a double-walled vertical tube 1322. The inner channel 1328 is internal the first channel wall 1324 and is in direct fluid connection with initially generated air flow. The second channel wall 1326 surrounds the first channel wall 1324 and the outer channel 1330 is sandwiched between the first channel wall 1324 and the second channel wall 1326. The channel walls may be tubular in shape. The first channel wall 1324 and the second channel wall 1326 may each be cylindrical or other appropriate shape for allowing air to flow through the channels effectively. It is to be understood that both the inner and outer channel may be located within the vertical tube 1322. The second channel wall 1326 may be an outermost wall of the vertical tube 1322.

The inner channel 1328 and the outer channel 1330 may be fluidly connected to one another near a top 1332 of the vertical tube 1322 as shown in FIG. 14. For example, a top space 1334 at a top of the vertical tube 1322 may be configured to fluidly connect the inner channel 1328 the outer channel 1330 and horizontal channels 1336. The first channel wall may be discontinuous with the top of the vertical tube 1322 to allow the inner channel, the outer channel, and the horizontal channels to be fluidly connected. As such, a space may be located between the first channel wall and the top 1332 of the vertical tube 1322. The horizontal channels 1336 may be defined by horizontal tubes 1338 that direct air flow from the vertical tube 1322 and/or inner channel 1328 toward a hair addition 1602 or a diffuser assembly 1604. An aperture 1340 may be included between the horizontal channels and/or the inner channel 1328 and/or the outer channel 1330 for the horizontal channels to receive air flow. For example, such apertures 1340 may be specifically configured to deliver even airflow to the variously sized horizontal channels and subsequently to the various diffuser assemblies 1604. A non-connected aperture 1342 may be included to release air flow that has not fully passed through the horizontal tubes 1338, for releasing air flow directly into the internal chamber without passing through a horizontal tubes. One or more of these non-connected apertures 1342 may be included and may be disposed in fluid connection with the outer channel 1330 and/or inner channel 1328.

The horizontal channels 1336, inner channel 1328, and outer channel 1330 may be fluidly connected in a specific manner. For example as shown in FIGS. 14 and 15, the airflow 1404 travels upward through internal channel from the air flow generator 1320, then is diverted or forced through both the horizontal tubes 1338 and the outer channel 1330. For example, airflow 1404 may be split at the interface of the inner channel 1328, the outer channel 1330, and the horizontal tubes 1338 such that some air flows through the horizontal tubes 1338 and some air flows downward through outer channel 1330. As such, the generated air flow 1404 first moves through the inner channel 1328 before being directed through both the horizontal channel 1336 and downward through the outer channel 1330. The constant flow from the inner channel 1328 forces air through both the horizontal channel 1336 and the outer channel 1330 and prevents air flowing back down the inner channel 1328. The inner channel 1328 and the outer channel 1330 may only be fluidly connected near the top 1332 of the vertical tube.

The outer channel receives air flow 1404 from the inner channel 1328 and directs or distributes air flow 1404 to further horizontal tubes 1338. For example, lower horizontal tubes (1306, 1308, 1310) and their respective horizontal channels (omitting a top-most horizontal tube), may be only fluidly connected to the outer channel 1330 and the diffuser assembly 1604 and not directly to the inner channel 1328. This configuration allows air to be primarily (or first) provided to a largest top wheel 1304 directly after passing through the inner channel 1328 before or right as the air flow is split at the interface of the inner channel 1328 and the outer channel 1330 and the horizontal channel 1336 of the top wheel 1304. After the air flow 1404 is split, the air flow 1404 may weaken in flow strength or flux, or a temperature (internal heat energy) may be lessened after the split. This splitting is desirable because the largest top wheel 1312 requires more airflow and more heat compared to lower smaller wheels (1306, 1308, 1310), and as the air flow travels further from the air flow generator, naturally heat energy of the air flow may dissipate. It is to be understood that heating elements may be disposed at any appropriate location in the dryer 1002, such as along the various tubes or in the air flow generator, to maintain an appropriate temperature of air flow.

The vertical tube 1322 have a radius that vertically lessens or tapers to a smaller radius. For example, outer channel 1330 may decreasingly taper toward a top end 1332 of the vertical tube. As shown in FIG. 13 the outer channel 1330 tapers in steps toward the top end 1332. The taper is configured to evenly direct airflow to all attachment points 1318 of all of the wheels. As such, each support wheel 1304 or horizontal tube 1338 may be fluidly connected to the vertical tube 1322 at each of the steps (e.g. at the vertical portions of the steps). For example, a given air flow or air flux applies a given pressure to a channel having a constant volume, radius or size. If the size of the channel decreases, the given pressure would increase (according to the ideal gas law), and in the case of the outer channel 1330, the larger wheels fluidly connected to the outer channel 1330 would receive airflow at a greater velocity and flux, which is desirable because upper wheels may be larger than lower wheels, and the taper allows the upper wheels fluidly connected to the outer channel to receive an appropriate amount of air flow.

Turning to FIG. 15, the diffuser assemblies 1604 may be removably attached to the horizontal channel 1336 or the support wheels 1304 via a male-female thread connection 1508 or screw mechanism as shown in FIG. 15. For example, attachment point 1318 and attachment 1506 may be configured to interlock for removably securing the diffuser assembly 1604 in an air tight manner. The attachment point 1318 and the attachment 1506 may be configured to maintain an air-tight fluid connection between the horizontal channel 1336 and an internal space of the diffuser assembly 1604. For example, the attachment 1506 may have an internal bore 1502, and the attachment point may have an attachment point bore 1504, and the attachment 1506 may be secured to the attachment point 1318 to form an air-tight fluid connection between the horizontal channel 1336, the attachment point bore 1504 and the internal bore 1502 when the attachment 1506 is removably attached to the attachment point 1318. It is to be understood that any appropriate attachment mechanism may be implemented to attach the attachment 1506 to the attachment point 1318 such as a snap-lock mechanism.

As shown in FIG. 16, the attachment 1506 of the diffuser assembly 1604 may include a non-porous neck 1610 that is substantially hollow or that defines an internal space (not visible in figures but is behind diffuser insert 1802 of FIG. 18) or channel. The neck 1610 may be continuously molded with portions of the attachment that fluidly connect to the horizontal channel 1336 such that the internal space of the neck 1610 is in air-tight fluid connection with the horizontal channel in an air-tight manner when the attachment 1506 is attached to the attachment point 1318. The neck 1610 may be open at a bottom end where the neck attaches to a diffuser 1608. In some embodiments the neck 1610 is removably attachable to the connection 1508 or a threaded portion of the attachment 1506 (e.g. via a second threaded connection). For example as shown in FIG. 18, the cylindrical piece 1804 (i.e. a port) may be removably securable to the neck 1610 to form an air tight fluid connection between the internal bore 1502 and the internal space of the neck 1610. The neck 1610 is configured to removably or non-removably attach to a diffuser 1608, the diffuser 1608 being configured to encapsulate or cover a hair addition 1602. For example, the hair addition support 1606 (i.e. weft support) may be a located inside the diffuser 1608 and the hair addition 1602 may be removably attached to the hair addition support 1606.

The diffuser 1608 may be vertically elongated and may be generally rectangular (e.g. rectangular prism) when viewed from the front. For example, the dimensions of the diffuser may have a length, a width, and a depth, where the length is a vertical dimension, the width being less than the length, and the depth being less than the width. Surfaces defined by both the length and width dimensions of the diffuser 1608 may be considered major surfaces. Surfaces defined by both the width and depth may be considered minor surfaces. Surfaces defined by both the length and depth may be considered minor surfaces as well. The diffuser 1608 may resemble a bag or a sleeve or a wrap in plain meaning of the terms. The attachment 1506 may be configured to attach to the attachment points 1318 in an air-tight manner such that the major front and/or back surfaces of the diffuser are/is held tangent with respect to a curvature of a support wheel 1304 that the diffuser 1608 is attached to.

As further shown in FIG. 16, the hair addition support 1606 extends from one wall or side of the diffuser 1608 to another wall or side of the diffuser 1608 across or inside an internal space 1612 defined by the diffuser 1608, and may extend along an internal width of the diffuser 1608. The hair addition support 1606 may include a clip 1614 having an arm 1904 and a clip body 1902. The hair addition support 1606 may secure, hold, or clip a hair addition 1602 as shown in FIG. 20 where an arm 1904 of the clip 1614 closes over the hair addition 1602 to a closed state, where the hair addition 1602 is held between the arm 1904 and the clip body 1902 of the clip such that a clipping force is applied to the hair addition. The hair addition 1602 may be released from the clip 1614 when the arm 1904 is adapting the open state as shown in FIG. 19. For example, the arm 1904 may be pivotably or rotatably attached to the clip 1614 or clip body 1902 at one end of the arm 1904 and/or one end of the clip 1614. The clip 1614 may include teeth or ridges 1906 to aid in securing the hair addition between the arm 1904 and the clip body 1902 in the closed state, and these teeth or ridges 1906 may be disposed on the clip body 1902 or the arm 1904, internally to contact the hair addition 1602 in the closed state. The arm 1904 may be secured in the closed position via any appropriate mechanism such as snap-lock mechanisms or magnetic mechanisms. In the closed position, the arm 1904 may apply a strong enough clipping force to a clipped or held hair addition 1602 such that the hair addition 1602 does not slip out of the clip 1614 when the hair addition is pulled or combed. This allows a user to have a free hand while pulling or combing on the hair addition. Turning back to FIG. 16, the hair addition support 1606 may be elevated inside the diffuser 1608 by attaching to internal sides of the diffuser 1608. For example, the longitudinal ends of the hair addition support 1606 may pass through apertures in the diffuser 1608 to rest on the diffuser 1608 in an elevated manner for suspending hair additions from the hair addition support 1606 inside the diffuser 1608.

The diffuser may include an access flap 1616 that is configured to open and close for a user to insert and remove the hair addition 1602. For example, the flap 1616 is shown in an open state of the diffuser 1608 in FIG. 16. In FIG. 17, the flap 1616 is shown in a closed state of the diffuser 1608. The flap 1616 may be detachably secured to the diffuser 1608 via any appropriate attachment mechanism, such as via hook and loop fasteners, buttons, zippers, tape, magnetics, or snap-lock mechanisms. The diffuser 1608 may have a closed bottom end 1618 but in some embodiments the bottom end 1618 is open. The diffuser may include a weight at a bottom end 1618 of the diffuser to keep the diffuser 1608 from swaying inside the internal drying chamber 1104 due to air convection that may occur inside the internal drying chamber 1104.

The diffuser 1608 may be a porous material that is configured to maintain an adequate temperature and airflow inside the diffuser 1608 without causing too much turbulence that may cause hair strands of the hair addition 1602 to tangle. For example, air received from the attachment 1506 may be hot and have a certain velocity or flux, and this heat, velocity, and/or flux may need to be dissipated from the internal space of the diffuser 1608 to reduce the turbulence or heat inside the internal space of the diffuser 1608. Curly hair may tangle easier than straight hair, and as such, the diffuser 1608 may be configured either for curly hair or straight hair. The material included in the diffuser 1608 may be foam or fabric. For example, the foam may be a foam material used in hand-held hair dryer diffusers or may be a smooth, soft, satin fabric. More particularly, for curly hair additions, the diffuser material may be configured to retain heat inside the diffuser 1608 while limiting turbulence inside the diffuser 1608.

As a third example of the diffuser, a diffuser insert 1802 may be inserted downstream from the attachment point 1318 of the horizontal tube 1338. This diffuser insert 1802 is shown in FIG. 18, and may be inserted in the neck 1610 or in the attachment 1506 and may conform to horizontal cross sections of the neck 1610 or the attachment 1506. The diffuser insert 1802 may be a porous fabric or may be a rigid structure having a plurality of pores or apertures that are configured to diffuse incoming airflow from the attachment point 1318 and/or the attachment 1506. The diffuser insert 1802 may be attached in an air-tight manner at a base of the neck 1610 to interrupt air from flowing through the neck into the diffuser 1608, thereby providing softer air flow through the diffuser insert 1802 to the hair addition 1602. The diffuser insert 1802 may be attached via a snap-lock mechanism or any appropriate attachment mechanism. The diffuser insert 1802 may be manufactured from silicone or any appropriate heat-resistant material. The diffuser insert 1802 may be flexible or non-flexible, and may be curved either upwardly or downwardly. It is to be understood that the clip 1614 or hair addition support 1606 is not shown in FIG. 18 and the clip 1614 or hair addition support 1606 could be disposed below the partial section indicator of FIG. 18. For example, it is to be understood that the diffuser insert 1802 is upstream from the clip 1614 or hair addition support 1606 (with respect to incoming air flow 1404) when the diffuser assembly 1604 is assembled. Likewise, it is to be understood that the clip 1614 or the hair addition support 1606 may be disposed downstream from the diffuser insert 1802.

FIGS. 19 and 20 show the hair addition support 1606 (i.e. clip 1614 or holder) being attachable to one or more clamps 1908 such that the hair addition support 1606 may be removably attached to a fixed structure 1910 such as a table or a chair for facilitating easy handling and manual hair drying. Once the hair addition support 1606 is clamped to the fixed structure 1910, a hair addition 1602 may be removably attached, clipped, or held in hair addition support 1606 by securing arm 1904 over the hair addition 1602 causing the hair addition 1602 to be clipped and secured between the arm 1904 and the clip body 1902 of the clip. While the hair addition support 1606 is attached to the clamps 1908 and while the clamps 1908 are attached to the fixed structure 1910, the hair addition 1602 may be secured in the clip 1614 while the clip 1614 is in the closed configuration. As shown in FIG. 20, the hair addition 1602, once secured, may be handled by a user while the hair addition 1602 is fixed relative to the surface 1910. For example, handling the hair addition 1602 may include combing, styling, drying, or trimming the hair addition 1602, or a combination thereof.

The clip 1614 of hair addition support 1606 may be the same clip 1614 implemented in the above diffuser assembly 1604, and may include the same functionalities and vice-versa. The clip 1614 may be generally longitudinal. The clamps 1908 (e.g. two clamps) may be located toward opposite longitudinal ends of the clip 1614. The clip 1614 or the hair addition support 1606 may be removably supportable on the clamp 1908. Each clamp 1908 may include a vertical bar 1912 that is configured to be secured to the clip 1614 at a longitudinal end of the vertical bar 1912. The clip 1614 may be vertically adjustable along the vertical bar 1912. The vertical bar 1912 may pass through the clip 1614 for allowing the clip 1614 to be vertically adjusted on the vertical bar 1912, or alternatively the clip 1614 may be sandwiched between two vertical bars 1912 such that the clip 1614 may slide up and down on the vertical bars.

It is to be understood that each of the clamps may attach to the fixed structure via two forks and a screw handle where the screw handle causes the forks to move toward one another and clamp the fixed structure between the forks. For example, existing table clamp mechanisms may be implemented to attach the clamp to the fixed structure as known in the art of table clamps.

In some embodiments, a knob 1914 may be tightenable to secure the clip 1614 in a particular position, and the knob 1914 may be loosened for a user to adjust the position of the clip 1614 on the vertical bar. For example, the vertical bars may include an adjustable sleeve 1916 which may include the knob 1914 such that when the knob is tightened, the sleeve becomes secured in place relative to the vertical bars 1912. As such, the clip 1614 may be attached to the sleeve(s) 1916 for being adjusted along with the sleeves 1916. It is to be understood that the functionalities, structures, and elements described with respect to the clip 1614 may invariably apply to the hair addition support 1606.

In conclusion, provided is a hair addition drying system configured to dry multiple hair additions evenly and safely without damaging or breaking the hair additions while keeping the hair additions untangled.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A holder for supporting a hair addition, the holder comprising:

a clamp configured to clamp onto a fixed structure;

a clip configured to hold the hair addition while the hair addition is handled;

wherein the holder further comprises a second clamp; and wherein the clamps are each located toward opposite longitudinal ends of the clip.

2. The holder of claim 1, wherein the clip is generally longitudinal.

3. The holder of claim 1, wherein the clip is removably supportable on the clamp.

4. The holder of claim 1, wherein the clip includes an arm that is configured to open to an opened state and close to a closed state, such that in the closed state the hair addition is holdable in the clip.

5. The holder of claim 1, wherein the clamp includes a vertical bar that is configured to be secured to the clip.

6. The holder of claim 1, wherein the fixed structure is a table.

7. The holder of claim 5, wherein the clip is vertically adjustable along the vertical bar.

8. A drying method for drying a hair addition having multiple strands of hair, the method comprising:

elevatingly supporting one end of the hair addition via a support;

applying air to the hair addition for drying the hair addition such that the strands are prevented from tangling; wherein the method includes the use of a holder for supporting the hair addition, the holder comprising:

a clamp configured to clamp onto a fixed structure;

a clip configured to hold the hair addition while the hair addition is handled;

wherein the holder further comprises a second clamp; and wherein the clamps are each located toward opposite longitudinal ends of the clip.

9. The method of claim 8, wherein the air is diffused via a diffuser.

10. The method of claim 8, wherein the method further comprises, manually engaging the hair addition while the air is applied to the hair addition.

11. The method of claim 8, wherein the method further comprises, hanging the hair addition from the support.

12. The method of claim 8, wherein the support is a clip.

13. The method of claim 8, wherein the support includes a clamp configured to clamp onto a fixed structure.

14. The method of claim 8, wherein the support includes an elevated bar.

15. A drying system for drying a hair addition having multiple strands of hair, the system comprising:

a dryer defining an internal drying chamber;

an internal support assembly configured to support the hair addition in the internal drying chamber as a supported hair addition;

an air flow system configured to provide flowing air to the supported hair addition for drying the hair addition; wherein the internal support assembly includes a holder for supporting the hair addition, the holder comprising:

a clamp configured to clamp onto a fixed structure;

a clip configured to hold the hair addition while the hair addition is handled;

wherein the holder further comprises a second clamp; and wherein the clamps are each located toward opposite longitudinal ends of the clip.

16. The drying system of claim 15, wherein the air flow system includes an air flow tube configured to direct air to the supported hair addition.

17. The drying system of claim 15, wherein the drying system further comprises a diffuser that is configured to diffuse the air before the supported hair addition is subjected to the air.

18. The drying system of claim 17, wherein the diffuser is configured to cover the supported hair addition.

* * * * *